US006609340B2

(12) United States Patent
Moore, Jr. et al.

(10) Patent No.: US 6,609,340 B2
(45) **Date of Patent: *Aug. 26, 2003**

(54) CONCRETE STRUCTURES AND METHODS OF FORMING THE SAME USING EXTENDERS

(75) Inventors: James Daniel Moore, Jr., Fort Lauderdale, FL (US); John A. Spragge, Port Hope (CA); Brian L. Smith, Garland, TX (US)

(73) Assignee: ECO-Block, LLC, Ft. Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/848,398

(22) Filed: May 3, 2001

(65) Prior Publication Data

US 2001/0027630 A1 Oct. 11, 2001

Related U.S. Application Data

(63) Continuation of application No. 09/821,299, filed on Mar. 29, 2001, now Pat. No. 6,481,178, which is a continuation-in-part of application No. 09/654,024, filed on Sep. 1, 2000, now Pat. No. 6,363,683, which is a continuation of application No. 09/008,437, filed on Jan. 16, 1998, now Pat. No. 6,170,220.

(51) Int. Cl.[7] ..... E04B 1/16

(52) U.S. Cl. ..... 52/309.11; 52/309.12; 52/426; 52/562; 52/742.14; 52/745.09

(58) Field of Search ..... 52/309.11, 309.12, 52/424, 425, 426, 562, 564, 565, 741.13, 742.14, 745.09, 745.2, 746.1

(56) References Cited

U.S. PATENT DOCUMENTS 798,773 A * 9/1905 Fisher ..... 52/426
963,776 A 7/1910 Kosack
1,053,231 A 2/1913 Schweikert (List continued on next page.)

FOREIGN PATENT DOCUMENTS

| | | |
|---|---|---|
| CA | 826584 | 11/1969 |
| CA | 1145584 | 5/1983 |
| CA | 1154278 | 9/1983 |
| CA | 1182304 | 2/1985 |
| CA | 1194706 | 10/1985 |
| CA | 1209364 | 8/1986 |
| CA | 1233042 | 2/1988 |
| CA | 1234701 | 4/1988 |
| CA | 1244668 | 11/1989 |
| CA | 1303377 | 6/1992 |
| CA | 1304952 | 7/1992 |
| CA | 2118343 | 10/1994 |
| CA | 2219414 | 10/1997 |
| DE | 28 04 402 | 8/1978 |

OTHER PUBLICATIONS

09/848,736, May 3, 2001—Commonly owned co–pending application (claims only; specification same as present application).

(List continued on next page.)

*Primary Examiner*—Brian E. Glessner
(74) *Attorney, Agent, or Firm*—Merchant & Gould, LLC

(57) ABSTRACT

A concrete structure formed using an extender that connects to a web member at least partially disposed within a side panel. The extender may be used to extend the length of a connector that interconnects opposed side panels, used to provide additional surface area to which concrete can bond if, for example, forming a tilt-up wall, or used as a strapping location with a flexible linking member. It is noted that this abstract is provided to comply with the rules requiring an abstract that will allow a searcher or other reader to ascertain quickly the subject matter of the technical disclosure. The abstract is submitted with the understanding that it will not be used to interpret or limit the scope or meaning of the claims pursuant to 37 C.F.R. §1.72(b).

36 Claims, 10 Drawing Sheets

U.S. PATENT DOCUMENTS 1,069,821 A 8/1913 Sherwood et al.
1,472,642 A * 10/1923 Evans, Jr. ..... 52/379
1,953,287 A 4/1934 Bemis
1,973,941 A 9/1934 Anderson
2,029,082 A 1/1936 Odam
2,248,348 A 7/1941 Hall
2,316,819 A 4/1943 Tedrow
2,750,648 A 6/1956 Hallock
3,286,428 A 11/1966 Kay
3,321,884 A * 5/1967 Klaue ..... 52/565
3,475,873 A 11/1969 Steadman
3,782,049 A 1/1974 Sachs
3,788,020 A 1/1974 Gregori
3,902,296 A 9/1975 Thomas
3,943,676 A 3/1976 Ickes
3,985,329 A 10/1976 Liedgens
4,177,617 A 12/1979 DeLucas et al.
4,223,501 A 9/1980 DeLozier
4,229,920 A 10/1980 Lount
4,438,612 A * 3/1984 Bernard et al. ..... 52/427
4,604,843 A 8/1986 Ott et al.
4,655,014 A 4/1987 Krecke
4,698,947 A 10/1987 McKay
4,706,429 A 11/1987 Young
4,730,422 A 3/1988 Young
4,731,968 A 3/1988 Obino
4,742,659 A 5/1988 Meilleur
4,765,109 A 8/1988 Boeshart
4,866,891 A 9/1989 Young
4,879,855 A 11/1989 Berrenberg
4,884,382 A 12/1989 Horobin
4,888,931 A 12/1989 Meilleur
4,889,310 A 12/1989 Boeshart
4,894,969 A 1/1990 Horobin
4,901,494 A 2/1990 Miller et al.
4,936,540 A 6/1990 Boeshart
4,949,515 A 8/1990 Krecke
4,967,528 A 11/1990 Doran
5,040,344 A * 8/1991 Durand ..... 52/52
5,074,088 A 12/1991 Bergeron
5,107,648 A 4/1992 Roby
5,140,794 A 8/1992 Miller
5,371,990 A 12/1994 Salah Uddin
5,390,459 A 2/1995 Mensen
5,428,933 A 7/1995 Philippe
5,459,971 A 10/1995 Sparkman
5,497,592 A * 3/1996 Boeshart ..... 52/699
5,566,518 A 10/1996 Martin et al.
5,570,552 A 11/1996 Nehring
D378,049 S 2/1997 Boeshart
5,611,183 A 3/1997 Kim
5,625,989 A 5/1997 Brubaker et al.
5,657,600 A 8/1997 Mensen
5,701,710 A 12/1997 Tremelling
5,704,180 A 1/1998 Boeck
5,735,093 A 4/1998 Grutsch
5,845,449 A 12/1998 Vaughn et al.
5,852,907 A 12/1998 Tobin et al.
5,857,300 A 1/1999 Gates
5,890,337 A 4/1999 Boeshart
5,896,714 A 4/1999 Cymbala et al.
5,992,114 A 11/1999 Zelinsky et al.
6,079,176 A 6/2000 Westra et al.
6,151,856 A * 11/2000 Shimonohara ..... 52/426
6,176,059 B1 1/2001 Cantarano et al.
6,178,711 B1 * 1/2001 Laird et al. ..... 52/427
6,230,462 B1 * 5/2001 Beliveau ..... 52/426
6,240,692 B1 6/2001 Yost et al.
6,247,280 B1 6/2001 Grinshpun et al.
6,263,638 B1 7/2001 Long, Sr.
6,314,694 B1 * 11/2001 Cooper et al. ..... 52/309.12
6,314,697 B1 * 11/2001 Moore, Jr. ..... 52/426
6,318,040 B1 * 11/2001 Moore, Jr. ..... 52/426
6,321,497 B1 * 11/2001 Cormier ..... 52/425

OTHER PUBLICATIONS

09/848,595, May 3, 2001—Commonly owned co–pending application (claims only; specification same as present application).

Promotion al advertisement for "*Quad–Lock Insulated Forms*," which appeared in Energy Source Builder #36, obtained from Building Technologies, Inc.'s website (Dec. 1994).

Promotional advertisement for "Thermalite" obtained from Thermalite, Inc.'s website (1997).

Promotional advertisement for "Reward" obtained from the internet (undated).

Promotional advertisement for "Polysteel Form" obtained from the internet (undated).

Promotional advertisement for "Isorat—Styropor Forms" obtained Hurricaine Homes & Construction Inc.'s website (undated).

Promotional advertisement for "I.C.E. Block Insulating Concrete Form" obtained from Oikos' wobsite (undated).

Promotional advertisement for "The Greenblock System" obtained from Greenbblock's website (undated).

Promotional advertisement for "Greenblock Building System" obtained from Greenblock's website (1996).

Promotional advertisement for "KEEVA Concrete Foam Froam Wall System" obtained from KEEVA's website (undated).

Promotional advertisement for Isorast Floor System (Jan. 1997).

W.A.M. Inc.'s brochure entitled "The ICE (Insulate Concrete Efficiently) Block" (undated).

A Product Profile of the Consulwal™ Concrete Forming System entitled "Concrete Forming, Concrete Block Construction—A Faster Alternative." (Undated).

Design of KT–Semi–Precast Panels (including translation) (undated).

"Overview of Building with Tilt–Up" obtained from Tilt–Up's website (Unknown).

09/427,373, filed Oct. 25, 1999—Co–pending Application to same applicant.

09/426,572, filed Oct. 25, 1999—Co–pending Application to same applicant (claims only; specification same as reference DK).

09/427,374, filed Oct. 25, 1999—Co–pending Application to same applicant (claims only; specification same as reference DK).

* cited by examiner

CONCRETE STRUCTURES AND METHODS OF FORMING THE SAME USING EXTENDERS

This application is a continuation of, and claims the benefit of, U.S. patent application Ser. No. 09/821,299 filed on Mar. 29, 2001, now U.S. Pat. No. 6,481,178 which is a continuation-in-part of U.S. patent application Ser. No. 09/654,024 filed on Sep. 1, 2000, now U.S. Pat. No. 6,363, 683 and which is a continuation of U.S. Ser. No. 09/008,437, now U.S. Pat. No. 6,170,220, filed Jan. 16, 1998, and issued Jan. 9, 2001, all of which are incorporated herein in their entireties.

BACKGROUND OF THE INVENTION

1. Field of the Invention

The present invention encompasses a building component used to make concrete structures.

2. Background Art

Concrete walls in building construction are most often produced by first setting up two parallel form walls and pouring concrete into the space between the forms. After the concrete hardens, the builder then removes the forms, leaving the cured concrete wall.

This prior art technique has drawbacks. Formation of the concrete walls is inefficient because of the time required to erect the forms, wait until the concrete cures, and take down the forms. This prior art technique, therefore, is an expensive, labor-intensive process.

Accordingly, techniques have developed for forming modular concrete walls that use a foam insulating material. The modular form walls are set up parallel to each other and connecting components hold the two form walls in place relative to each other while concrete is poured therebetween. The form walls, however, remain in place after the concrete cures. That is, the form walls, which are constructed of foam insulating material, are a permanent part of the building after the concrete cures. The concrete walls made using this technique can be stacked on top of each other many stories high to form all of a building's walls. In addition to the efficiency gained by retaining the form walls as part of the permanent structure, the materials of the form walls often provide adequate insulation for the building.

One embodiment of form walls is disclosed in U.S. Pat. No. 5,390,459, which issued to Mensen on Feb. 21, 1995, and which is incorporated herein by reference. This patent discloses "bridging members" that comprise end plates connected by a plurality of web members. The bridging members also use reinforcing ribs, reinforcing webs, reinforcing members extending from the upper edge of the web member to the top side of the end plates, and reinforcing members extending from the lower edge of the web member to the bottom side of the end plates. As one skilled in the art will appreciate, this support system is expensive to construct, which increases the cost of the formed wall. Also, these walls cannot feasibly be used to make floors or roof panels.

SUMMARY OF THE INVENTION

The present invention provides an insulated concrete form comprising at least one longitudinally-extending side panel and at least one web member partially disposed within the side panel. The web member extends from adjacent the external surface of the side panel through and out of the interior surface of the side panel. Three embodiments of the present invention that may be used to construct a concrete form are described herein. The first embodiment uses opposed side panels that form a cavity therebetween into which concrete is poured and substantially cured. The second embodiment uses a single side panel as a form, onto which concrete is either poured or below which concrete is poured and the form inserted into. Once the concrete cures and bonds to the side panel in the second embodiment, it is used as a tilt-up wall, floor, or roof panel. The third embodiment operates similar to the first embodiment but, instead of having two opposed side panels to form the cavity, the present invention uses one side panel and an opposed sheet or other form on the opposed side to form the cavity. After the concrete substantially cures in the third embodiment, the sheet can be removed and reused again or, alternatively, remain as part of the formed structure. If the sheet is removed, the resulting structure is similar to a tilt-up wall formed using the second embodiment of the present invention.

In the first embodiment, the web member is preferably partially disposed in the side panel so that a portion of the web member projects beyond the interior surface of the side panel and faces but does not touch an opposing side panel. The first embodiment also uses a connector that attaches to the two web members in opposing side panels, thereby bridging the gap between the two side panels to position the side panels relative to each other. The connectors preferably have apertures to hold horizontally disposed re-bar. The connectors also have different lengths, creating cavities of different widths for forming concrete walls having different thicknesses. The connectors are interchangeable so that the desired width of the wall can be set at the construction site.

For the second embodiment, a portion of the web member preferably projects beyond the interior surface of the side panel. In one design, the side panel is first horizontally disposed so that the interior surface and portion of the web member extending therethrough are positioned upwardly. Forms are placed around the periphery of the side panel and concrete is then poured onto the interior surface. In a second design, the concrete is poured into a volume defined by perimeter forms and then the side panel is placed upon the fluid concrete so that at least a portion of the web member in the side panel is disposed in the concrete. Alternatively, a third design is formed as a hybrid of the first and second designs, namely, one side panel is horizontally disposed, concrete is poured onto the interior surface and contained by forms, and then another panel is place upon the poured concrete so that side panels are on both sides of the concrete. For all three designs, once the concrete substantially cures and bonds with the interior surface of the side panel and the portion of the web member extending therethrough, the side panels and connected concrete slab can be used as a tilt-up wall, flooring member, or roof panel.

The third embodiment of the present invention encompasses a process generally similar to the first embodiment, except that a sheet of plywood or the like is used instead of a second side panel. The sheet can either be removed after the concrete cures and used again or remain part of the formed structure.

The present invention further comprises components to improve the walls formed using side panels and to simplify the construction process.

BRIEF DESCRIPTION OF THE FIGURES OF THE DRAWINGS

FIG. 2A also shows the tilt-up wall formed with side panels on the two opposed sides of the concrete that has been erected.

FIG. 6 also shows an anchor and an extender used in conjunction with the different embodiments of the present invention.

DETAILED DESCRIPTION OF THE INVENTION

The present invention is more particularly described in the following examples that are intended as illustrative only since numerous modifications and variations therein will be apparent to those skilled in the art. As used in the specification and in the claims, "a," "an," and "the" can mean one or more, depending upon the context in which it is used. The preferred embodiment is now described with reference to the figures, in which like numbers indicate like parts throughout the figures.

Figure 7:
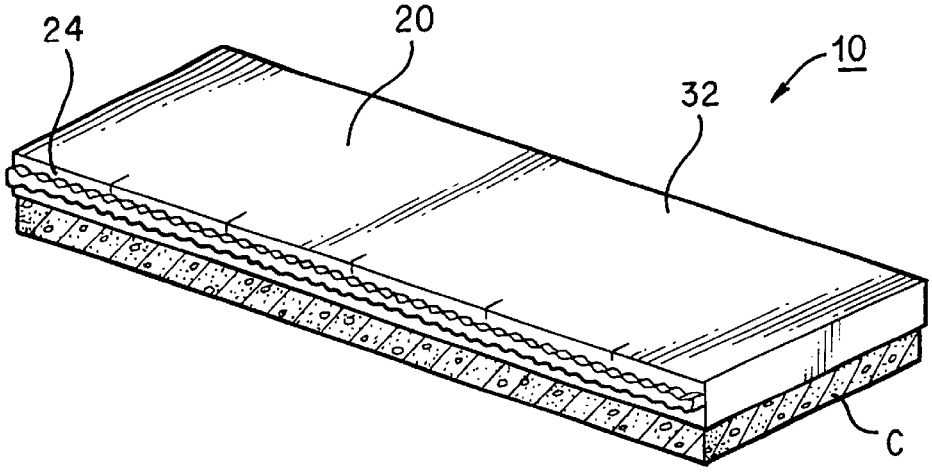
FIG. 7 is a perspective view of a second embodiment of the present invention showing generally the concrete formed below the side panel.
Figure 8:
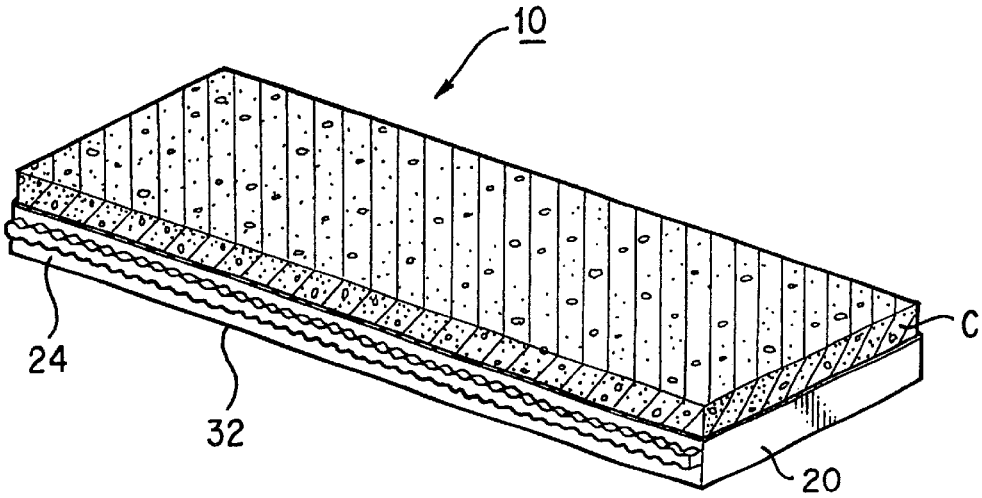
FIG. 8 is another perspective view of the second embodiment of the present invention showing generally the concrete formed above the side panel.
Figure 9:
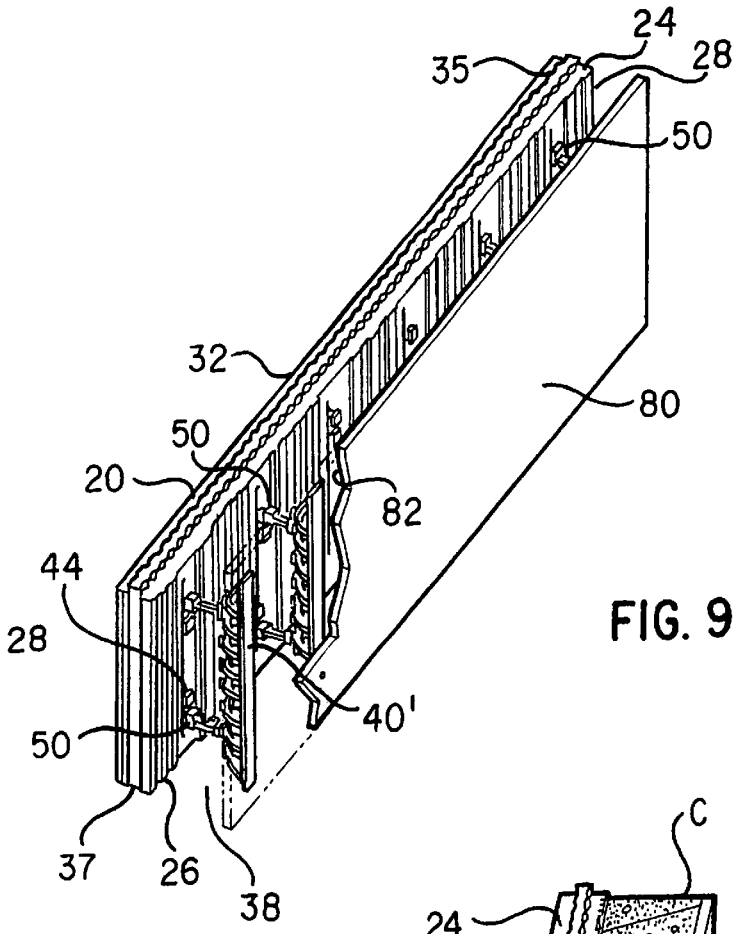
FIG. 9 is a perspective view of a third embodiment of the present invention showing a cavity defined by a side panel and a sheet.
Figure 9A:
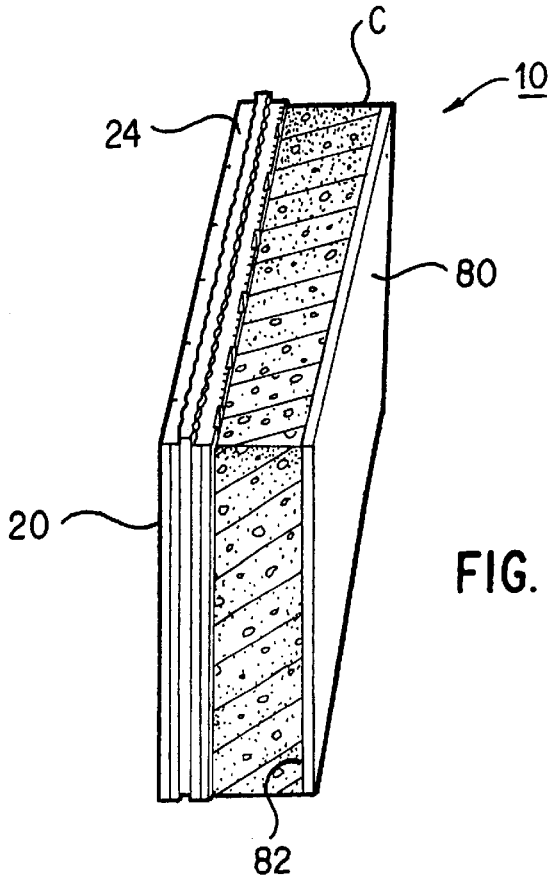
FIG. 9A is an alternative view of FIG. 9 showing concrete disposed between the side panel and the sheet.

As shown in FIGS. 1–12, the present invention comprises a concrete form system 10 used for constructing buildings. A first embodiment of the present invention, shown best in FIGS. 1–2A, comprises at least two opposed longitudinally-extending side panels 20, at least one web member 40 partially disposed within each of the side panels 20, and a connector 50 disposed between the side panels 20 for connecting the web members 40 to each other. As shown in FIG. 2A, concrete C is poured between the side panels 20 so that it bonds with the side panels 20 and the web members 40. Two designs of a second embodiment of the present invention, which is discussed in more detail below and shown in FIGS. 7 and 8, involves using a single side panel 20 that bonds with the concrete C, instead of using opposed side panels 20 on both sides of the concrete C. The second embodiment also includes a design in which the wall has side panels 20 on both sides of the concrete to appear as the wall in FIG. 2A, but is formed differently from the first embodiment. A third embodiment of the present invention is shown in FIGS. 9 and 9A and is similar to the first embodiment, but uses one side panel 20 and a sheet 80 instead of two opposed side panels 20.

Each side panel 20 has a top end 24, a bottom end 26, a first end 28, a second end 30, an exterior surface 32, and an interior surface 34. The presently preferred side panel 20 has a thickness (separation between the interior surface 34 and exterior surface 32) of approximately two and a half (2½) inches, a height (separation between the bottom end 26 and the top end 24) of sixteen (16) inches, and a length (separation between the first end 28 and second end 30) of forty-eight (48) inches. The dimensions may be altered, if desired, for different building projects, such as increasing the thickness of the side panel 20 for more insulation. Half sections of the side panels 20 can be used for footings.

Figure 1:
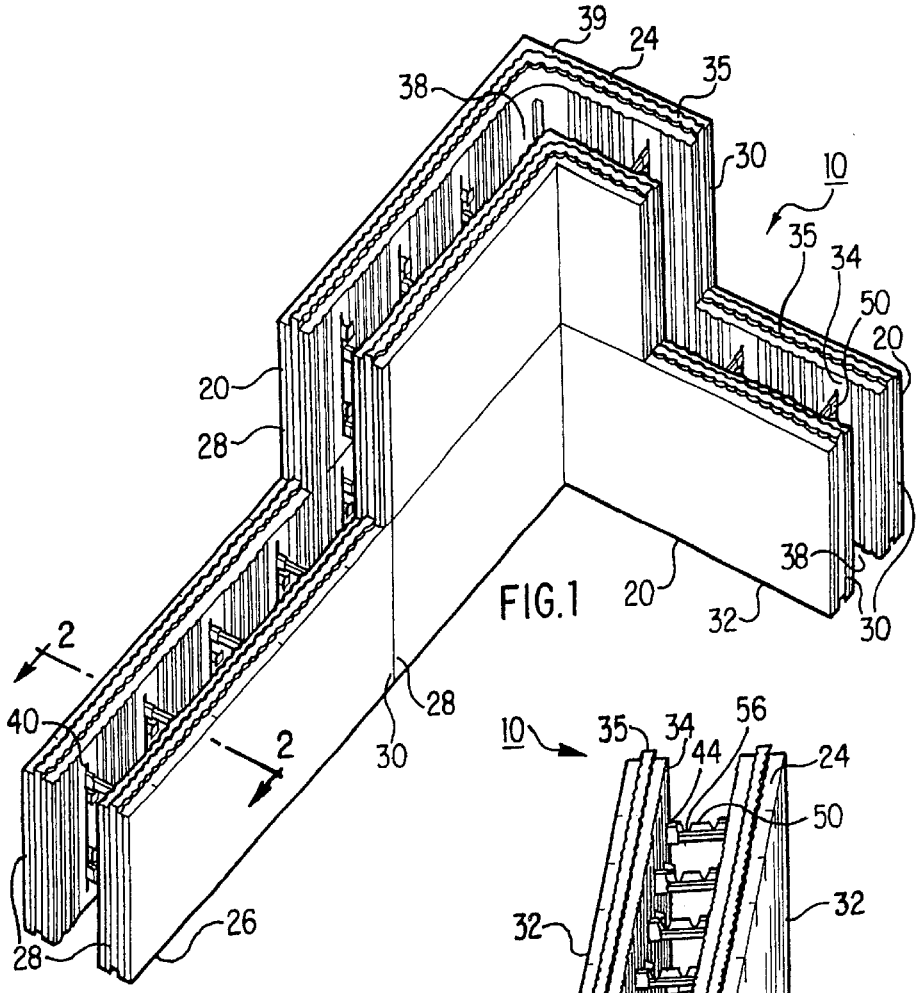
FIG. 1 is a perspective view of a first embodiment of the present invention.
Figure 2:
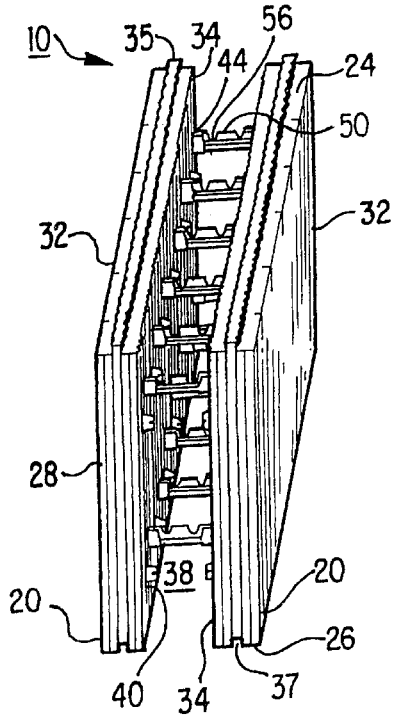
FIG. 2 is a perspective side view of a FIG. 1 taken along line 2—2.
Figure 2A:
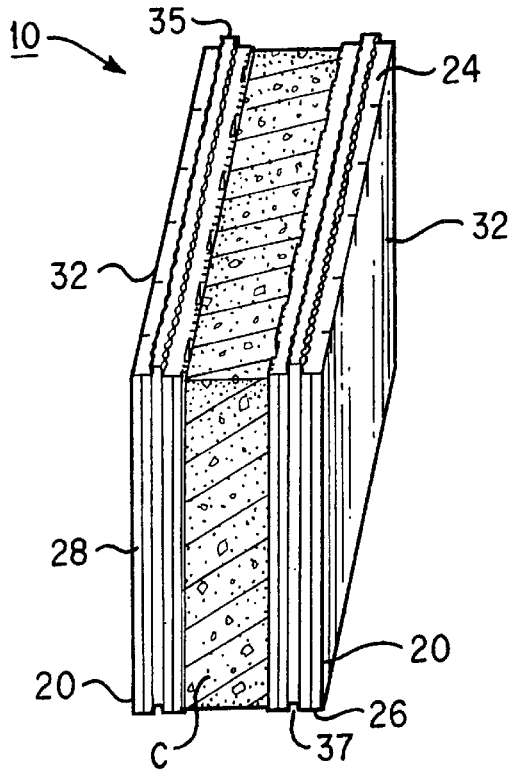
FIG. 2A is an alternative view of FIG. 2 showing concrete disposed between the two opposed side panels.

Referring now to FIGS. 1 and 2 showing the first embodiment of the present invention, the interior surface 34 of one side panel 20 faces the interior surface 34 of another side panel 20 and the opposed interior surfaces 34 are laterally spaced apart from each other a desired separation distance so that a cavity 38 is formed therebetween. Concrete—in its fluid state—is poured into the cavity 38 and allowed to substantially cure (i.e., harden) therein to form the wall 10, as shown in FIG. 2A. Preferably, for the first embodiment, the opposed interior surfaces 34 are parallel to each other. The volume of concrete received within the cavity 38 is defined by the separation distance between the interior surfaces 34, the height of the side panels 20, and the length of the side panels 20.

The side panels 20 are preferably constructed of polystyrene, specifically expanded polystyrene ("EPS"), which provides thermal insulation and sufficient strength to hold the poured concrete C until it substantially cures. The formed concrete wall 10 using polystyrene with the poured concrete C has a high insulating value so that no additional insulation is usually required. In addition, the formed walls have a high impedance to sound transmission.

Figure 3:
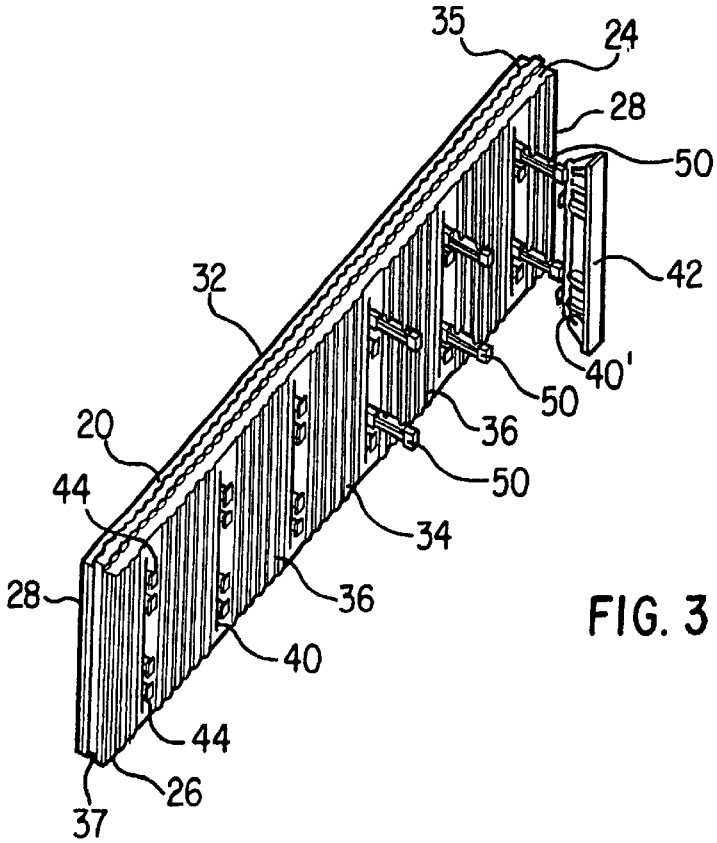
FIG. 3 is a perspective view of one side panel shown in FIG. 1, in which three web members show four attachment points extending through the interior surface of the side panel. Two of the web members show two connectors attached to attachment points and one web member shows two connectors and a stand-alone web member attached to those two connectors.
Figure 5:
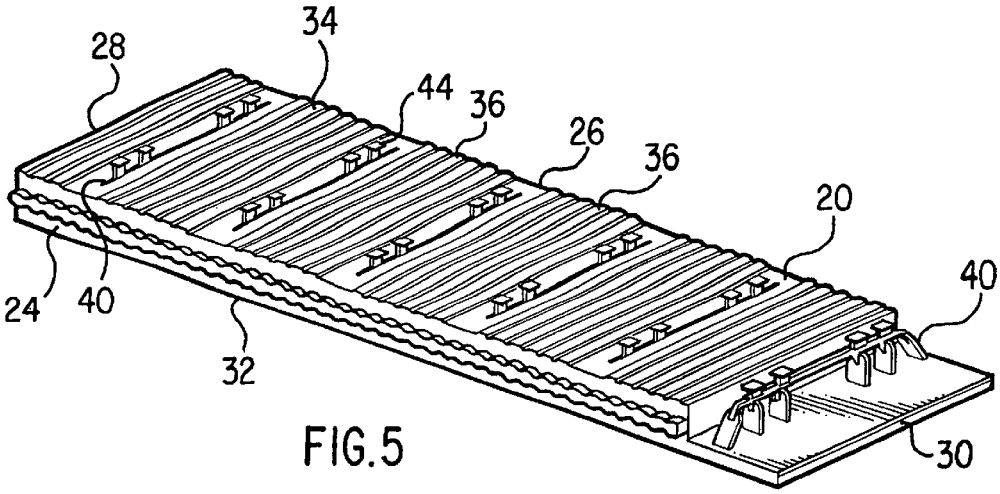
FIG. 5 is a perspective view of one design of the side panel of the present invention, in which a portion of the side panel is cut away to show the body portion of the web member partially disposed and integrally formed therein.
Figure 14:
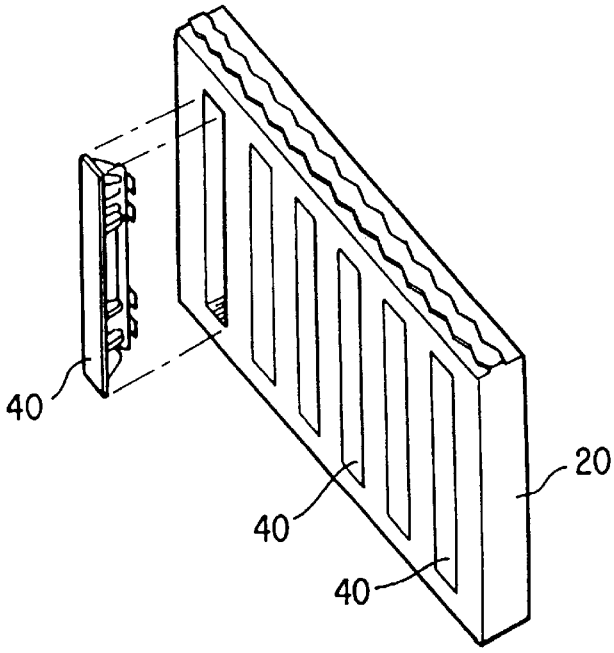
FIG. 14 is an expanded perspective view of a web member removable insertable into a side panel.

As best shown in FIGS. 3 and 5, the interior surface 34 preferably includes a series of indentations 36 therein that increase the surface area between the side panels 20 and concrete C to enhance the bond therebetween. To improve further the bond between the side panels 20 and the concrete C poured in the cavity 38, a portion of each of the web members 40 formed in or passing through the side panels 20 extends through the interior surface 34 of the side panels 20 into the cavity 38. A portion of each web member 40 is preferably integrally formed within one side panel 20 and is also cured within the concrete C so that the web member 40 strengthens the connection between the side panel 20 and the concrete C. That is, since the web member 40 is preferably an integral part of the side panel 20, it bonds the side panel 20 to the concrete C once the concrete is poured and substantially cures within the cavity 38. However, other designs are contemplated, such as designs in which the web member is not integrally formed into the side panel and, for example, the web member is slid into slots precut into the side panel at the construction site, which is shown in FIG. 14.

As shown in FIGS. 1–3 and 5, each side panel 20 has at least one web member 40 formed into it. Preferably, the each web member 40 formed within one side panel 20 is separated a predetermined longitudinal distance from other web members 40, which is typically eight (8) inches. Based on the preferred length of the side panel 20 of forty-eight (48) inches, six web members 40 are formed within each side panel 20, as shown in FIGS. 3 and 5.

Portions of each web member 40 that extend through the interior surface 34 of the side panel 20 forms one or more attachment points 44. The attachment points 44 are disposed within the cavity 38 and are preferably spaced apart from the interior surface 34 of the side panels 20 in the first embodiment. However, as one skilled in the art will appreciate, the attachment points 44 may take any of a number of alternate designs formed by or independently of the web members 40, including as examples: slots, channels, grooves, projections or recesses formed in the side panels; hooks or eyelets projecting from or formed into the side panels; twist, compression or snap couplings; or other coupling means for engaging cooperating ends of the connectors.

Preferably, as addressed in more detail below and as shown best in FIGS. 3, 5, and 6, each attachment point 44 is substantially rectangular and flat in plan view to be complementarily and slidably received within one respective end 52 of the connector 50. Thus, in the first embodiment, the connectors 50 shown in FIGS. 4 and 4A engage two attachment points 44 on opposed web members 40, which position the interior surfaces 34 of the side panels 20 at a desired separation distance and support the side panels 20 when the fluid concrete is poured into the cavity 38. In the preferred embodiment, the connector 50 makes a two-point connection with opposed web members 40 because each connector has two ends 52 that each couple to one attachment point 44, although it is contemplated making a four-point connection (i.e., each connector 50 engages four attachment points 44 instead of two as illustrated in the figures).

Figure 6:
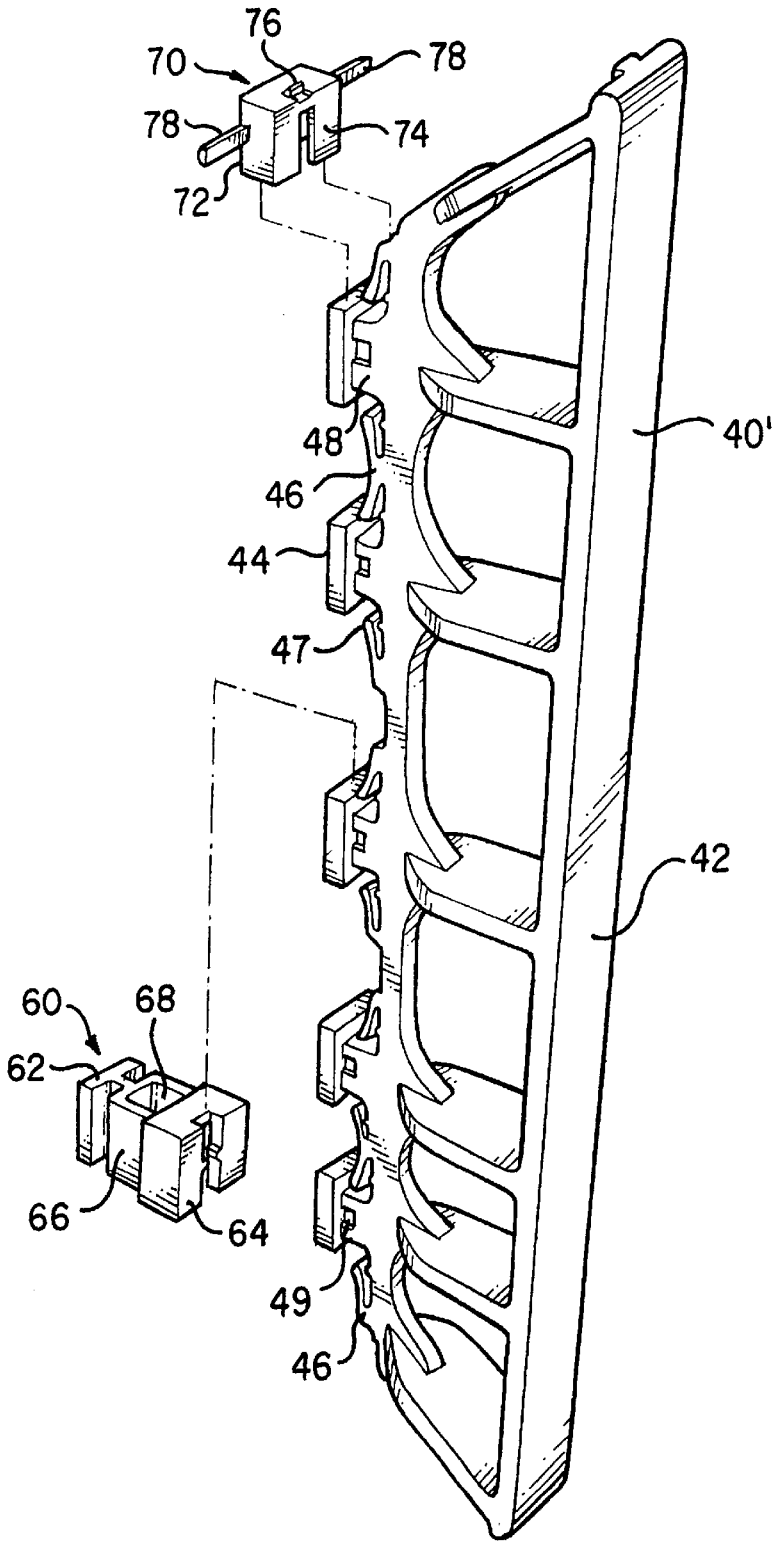
FIG. 6 is an exploded perspective view of an alternative design of the web member shown in FIGS. 3 and 5 and having five attachment points instead of four.
Figure 10A:
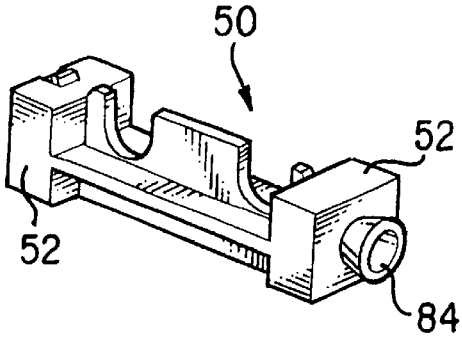
FIG. 10 is a perspective view of a stand-alone web member and a connector, both of which include a spacer.
Figure 10:
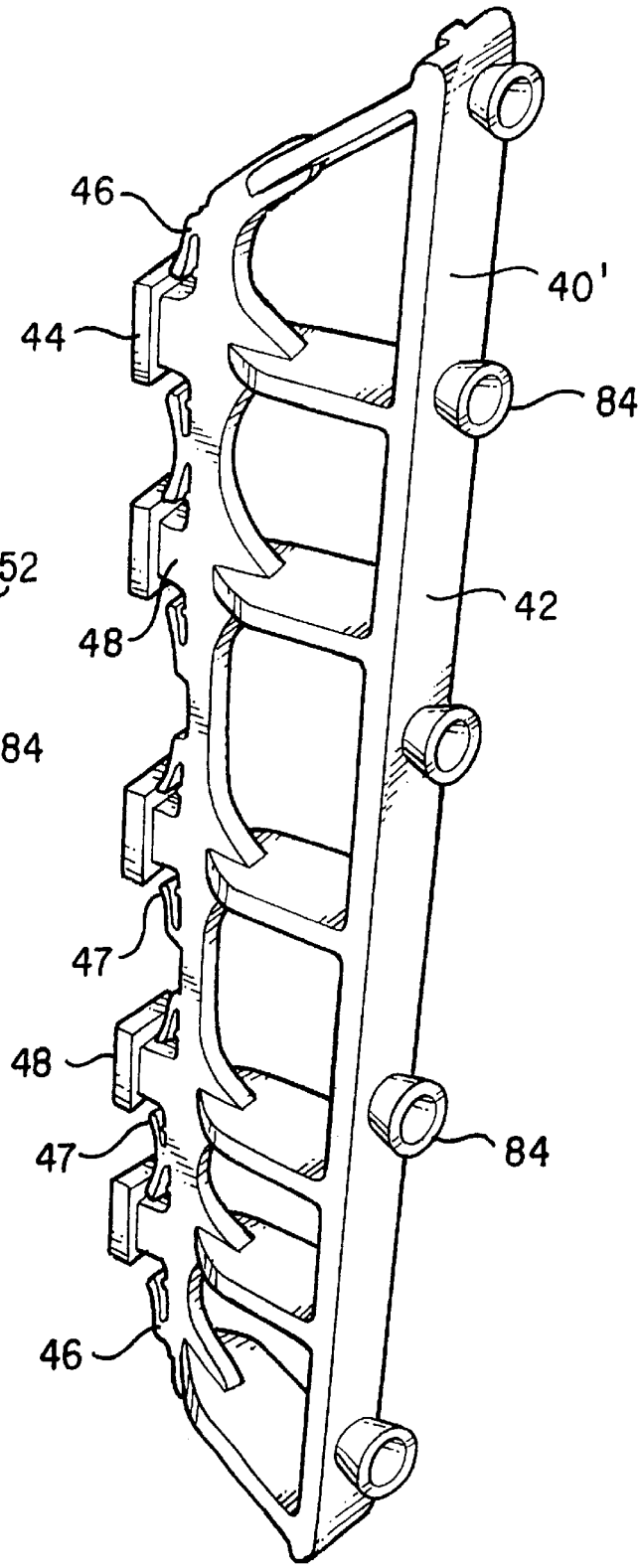

Referring now to FIGS. 3, 6, and 10, each web member 40 also preferably has an end plate 42 that is disposed adjacent the exterior surface 32 of the side panel 20 in the preferred embodiment. The end plates 42 are preferably substantially rectangular in plan view. Except when used as a stand-alone web member 40' for the third embodiment as discussed below, each end plate 42 of the web members 40 is preferably completely disposed within a portion of one respective side panel 20, as shown best in FIGS. 2 and 5. That is, the end plates 42 are located slightly below the exterior surface 32 of, or recessed within, the side panel 20, preferably at a distance of one-quarter (¼) of an inch from the exterior surface 32. This position allows for easily smoothing the surface of the side panels 20 without cutting the end plate 42 should the concrete, when poured, create a slight bulge in the exterior surface 32 of the side panels 20. However, when embedded within the side panel 20, it is desired that some visual indicia be included on the external surface 32 to enable the construction worker to locate quickly and accurately the end plate 42. Alternatively, the end plates 42 can abut the exterior surface 32 of panels 20 so that a portion of the end plate 42 is exposed over the exterior surface 32. It is also preferred in the first and third embodiments that each end plate 42 is oriented substantially upright and disposed substantially parallel to the exterior surface 32 of the side panel 20 when forming a concrete form 10.

Similar to the end plate 42, the attachment points 44 are also preferably oriented substantially upright in the first and third embodiments so that one attachment point 44 is disposed above another attachment point 44. As best shown in FIGS. 2, 3, and 9, in one design each of the web members 40 has four spaced-apart attachment points 44, in which the attachment points 44 for each web member 40 are vertically disposed within the cavity 38 in a substantially linear relationship. The attachment points 44 are placed in two groups-a top group of two attachment points 44 and a bottom group of two attachment points 44. Adjacent attachment points 44 in the two groups are spaced apart a first distance from each other, preferably approximately two and an eighth (2⅛) inches apart between center points. In addition, the closest attachment points 44 of the two groups, i.e., the lowermost attachment point 44 of the top group and the uppermost attachment point 44 of the bottom group, are spaced apart a second distance from each other. The second distance, which is approximately six (6) inches in the preferred embodiment for a twelve (12) inch connector, is more than double and almost triple the first distance.

In an alternative design, the web member 40 includes five attachment points 44, which is illustrated best in FIG. 6. This design also has the two groups of two attachment points 44 as discussed above, but also includes a fifth attachment point 44 at approximately the center of the two groups. This design having five attachment points 44 is presently preferred over the web member 40 having four attachment points because it provides even greater flexibility for the architect and/or construction worker. As one skilled in the art will appreciate, the number of attachment points 44 used for each web member 40 can be further varied in number and spacing based on relevant factors such as the dimensions of the side panels 20 and the wall strength or reinforcement desired.

The designs of the multiple attachment points 44 of the present invention is an improvement over prior art systems, which lack multiple mounting points for attaching an interconnecting device. The side panels 20 and web members 40 in the present invention can be cut horizontally over a wide range of heights to satisfy architectural requirements, such as leaving an area for windows, forming odd wall heights, and the like, yet still have at least two or three attachment points 44 to maintain structural integrity of the wall. Prior art systems, in contrast, lose structural integrity if cut horizontally, thus requiring extensive bracing to resist collapsing when concrete is poured into the cavity between the panels. One skilled in the art, however, will appreciate that the web member of the present invention is not limited to these exemplary designs and can include other shapes in which a portion is disposed adjacent both the interior and exterior surfaces in which the web member is disposed.

Referring again to FIGS. 1 and 2 showing the first embodiment of the present invention, the attachment points 44 of the web members 40 extend into the cavity 38 and the attachment points 44 of each web member 40 formed within one side panel 20 are spaced apart from the attachment points 44 of the web members 40 formed within the opposed side panel 20. Thus, the web members 40 preferably do not directly contact each other; instead, each attachment point 44 independently engages the connector 50 that interconnects the web members 40 and, accordingly, the side panels 20.

Figure 4:
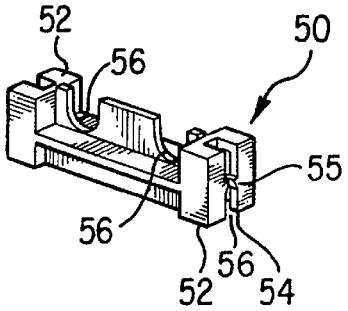
FIG. 4 is a perspective view of the connector shown in FIG. 3.
Figure 4A:
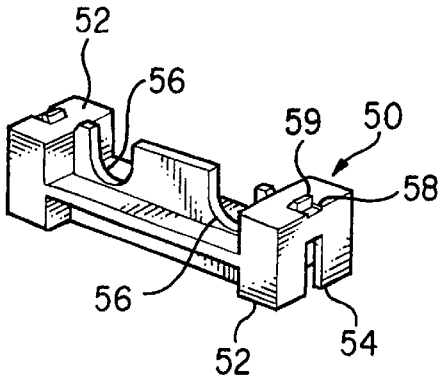
FIG. 4A is a perspective view of an alternative of the connector shown in FIG. 4.

Referring now to FIGS. 4 and 4A, the illustrated connectors 50 have opposed ends 52 and a length extending therebetween. The ends 52 of the connectors 50 are each of a shape to engage one attachment point 44 of two respective web members 40 within opposed panels. As mentioned above and as best shown in FIGS. 5, 6, and 12, the attachment points 44 are preferably substantially rectangular and flat and a stem 48 extends the attachment point 44 through the side panel 20 from the remaining portions of the web member 40. As such, the stem 48 and the attachment point 44 are "T" shaped in cross-sectional view, in which the attachment point forms the top of the "T."

In conjunction, as best shown in FIGS. 4 and 4A, each end 52 of the connector 50 has a track 54 into which the preferably rectangular attachment point 44 is complementarily and slidably received. The connector 50, accordingly, is movable between a separated position and an attached position. In the separated position (as illustrated, for example, in FIGS. 4 and 4A), the end 52 of the connector 50 is spaced apart from the respective attachment point 44 to which it will be connected. In the attached position, the end 52 of the connector 50 is engaged to the attachment point 44, which is shown, for example, in FIGS. 2 and 3.

In the preferred embodiment, the ends 52 of the connector 50 are detachably locked to the respective attachment points 44 when in the attached position. By being detachably locked, it will be appreciated that, while only contacting the connector 50, an applying force needed to remove the connector 50 from the attachment point 44 is greater than a force needed to attach that connector to that attachment point 44. Stated differently, an applying force needed to move the connector 50 from the separated to the attached position is less than a removing force needed to move the connector 50 from the attached to the separated position. The differences in the applying and removing forces may be slight or significant and still be within the scope of the present invention.

The present invention thus comprises a means for detachably locking the end 52 of the connector 50 into the attached position. The preferred embodiment of the locking means is illustrated in FIGS. 4A and 6. Referring first to FIG. 6, latching members 46 are disposed either above and below the attachment points 44, although it is acceptable if only one latching member 46 is disposed either above or below the attachment point 44. The latching members 46 are preferably integrally formed as part of the web member 40, but can alternatively either be affixed to the web member 40 after it is formed or be connected to the side panel 20. As shown in FIG. 6, the tip 47 of the latching member 46 is spaced apart from the attachment point 44 and, preferably, flexibly movable but predisposed or biased to be in an extended position, again as shown in FIG. 6. Since it is preferred that the tip 47 of the latching member 46 be flexible, the latching member 46 may be formed as a relatively thin component, which should not prevent the latching member 46 from performing its intended function.

In conjunction, referring again to FIG. 4A, the connector 50 has a detent 58 disposed above its track 54. Specifically, the illustrated detent 58 is an indentation formed at the center of the closed end of the track 54 (which is shown as the top end in FIG. 4A). It is further preferred that the detent 58 include a raised back 59 that is located at the back end of the detent 58. As one skilled in the art will appreciate, however, the detent 58 can be aligned differently such that, for example, the detent 58 is in the center of the closed end of the track 54 instead of at its top or the detent 58 is off-center instead of in the middle of the closed end.

To move the connector 50 shown in FIG. 4A to the attached position onto the web member 40 shown in FIG. 6, the bottom of the track 54 of the connector 50 is aligned with the top edge of a one attachment point 44 and slid vertically downwardly while the web member 40 is oriented in an upstanding position. Although not preferred or discussed further, the connector could alternatively be aligned with the bottom edge of the selected attachment point and slid upwardly. As the closed portion of track 54 of the connector 50 slides closer to the attachment point 44 while moving downwardly, the closed portion contacts the flexible tip 47 of the latching member 46. That contact moves the tip 47 of the latching member 46 inwardly toward the end plate 42 of the web member 40 until the detent 58 is aligned with the tip 47 of the latching member 46, at which time the latching member 46 extends outwardly away from the end plate 42 to its normal extended position to be complementarily received within the detent 58. Thus, at that point (which preferably is reached when the attachment point 44 is fully received within the track 54 of the connector 50), the connector 50 is detachably locked into place by the tip 47 of the latching member 46 being positioned within the detent 58 so that the connector 50 cannot be freely removed from the attachment point 44. In conjunction, the raised back 59 behind the detent 58 prevents the tip 47 from over extending beyond the detent 58.

As one skilled in the art will appreciate, the locking means shown in FIGS. 4A and 6 allows the connector 50 to be easily slid down onto the attachment point 44 using very light downward force (i.e., with just two fingers) to latch the connector 50 to the attachment point 44. That is, the preferred embodiment of the connector 50 shown in FIGS. 4A and 6 allows a construction worker to slide relatively "loosely" the end 52 of the connector 50 onto the attachment point 44 without significant frictional resistance. Such a design is advantageous because even mild frictional resistance may be burdensome given the number of connectors 50 involved in some construction projects, which may literally involve thousands of connectors 50 each attaching to two web members 40 in opposed side panels 20. The scope of the connections made may be appreciated by considering FIG. 2, which shows the connections for one pair of opposed side panels 20. As such, this less burdensome process may translate into a reduction in the amount of time necessary to attach the connectors 50 to the attachment points 44.

To remove the connector 50 from the attachment point 44 back to the separated position (which is unusual to occur during a construction project), the flexible tip 47 of the latching member 46 must be pressed inwardly away from the detent 58 and toward the end plate 42 and, concurrently, the connector 50 must be slid upwardly toward the latching member 46 a sufficient distance so that the tip 47 of the latching member 46 is no longer aligned or in registry with the detent 58. After this initial movement, the connector 50 can be removed from the attachment point 44, either while still holding the tip 47 of the latching member 46 in the compressed position or releasing the latching member 46 so that its tip 47 contacts the closed portion of the track 54.

Thus, although there is low frictional resistance moving the connector 50 to the attached position, the detachably locked connector 50 cannot easily be removed—even with strong upward force—unless the flexible tip 47 of the latching member 46 is compressed, which often requires a two-handed operation to separate the connector 50 from the web member 40. This latching design further allows a construction worker or foreman to verify that a connector 50 is properly attached to the web members 40 by tapping on the bottom of the connector 50 and having the connector 50 remain in place, whereas other designs might result in the connector 50 "popping off" the attachment points 44 in response to such an upward tapping force. Further, the detachably locking design also more effectively resists the upward forces exerted by concrete to the connectors 50 as the fluid concrete is first placed, or pumped, into the cavity 38 of the concrete form. In so resisting the forces applied by the fluid concrete, the connectors 50 keep the side panels 20 in place and maintain the integrity of the structure when subjected to various forces or pressures.

Another embodiment of the locking means is shown referring to FIG. 4. As will be noted, the track 54 of the connector 50 forms a gap 56 into which a portion of the stem 48 is complementarily received when the connector 50 is moved to the attached position. The locking means in this embodiment comprises at least one barb 55 on the track 54 of the connector 50 that is oriented into the gap 56 and a corresponding indentation 49 on the stem 48 of the web member 40 (as shown in FIG. 6). As such, when the connector 50 is in the attached position, the barb 55 is complementarily received into the indentation 49. FIG. 4 shows two spaced-apart barbs 55 extending toward each other in the gap and there would be two corresponding indentations 49 formed into the stem 48. These barbs 55 provide a frictional fit between the connector 50 and the attachment point 44 of the web member 40 to hold the connector 50 at the attached position. However, the frictional resistance also exists when moving the connectors 50 to the attached position, which makes this embodiment of the locking means less desired.

One skilled in the art will appreciate that the locking means for the connectors 50 can also be used for the stanchions (some embodiments of which are discussed below and shown in FIG. 6). One skilled in the art will further appreciate that other locking means are possible, such as having the latching member 46 formed on the connector 50 and the detent 58 formed on the web member 40.

Referring again to FIGS. 2, 4, and 4A, the connectors 50 also preferably define an aperture 56 of a size to complementary receive a re-bar (not shown) therein. The rebar provides reinforcing strength to the formed wall. The diameter of the re-bar can be one quarter (¼) inch or other dimension as required for the necessary reinforcement, which depends on the thickness of the concrete wall and the design engineering requirements. The connectors 50 preferably have two or more apertures 56 and re-bar can be positioned in any of the apertures 56 before the concrete is poured into the cavity 38. The apertures 56 can be designed so that the re-bar is securably snapped into place for ease of assembly.

To vary the width of the cavity 38 (i.e., the separation between the interior surfaces 34 of the opposed side panels 20), different connectors 50 can have varying lengths. The width of the cavity 38 can be two (2), four (4), six (6), eight (8) inches or greater separation. Different connectors 50 are sized accordingly to obtain the desired width of the cavity 38. Also, as one skilled in the art will appreciate, the fire rating, sound insulation, and thermal insulation increase as the width of the cavity 38, which is filled with concrete, increases. One skilled in the art will appreciate that the cavity 38 may only be partially filled with concrete, but such an embodiment is not preferred or desired.

The web members 40 and connectors 50 are preferably constructed of plastic, more preferably high-density plastic such as high-density polyethylene or high-density polypropylene, although other suitable polymers may be used. Other contemplated high-density plastics include acrylonitrile butadiene styrene ("ABS") and glass-filled polyethylene or polypropylene, particularly for connectors and stanchions since they are more expensive materials. Factors used in choosing the material include the desired strength of the web member 40 and connector 50 and the compatibility with the material used to form side panels 20 and with the concrete. Another consideration is that the end plates 42 should be adapted to receive and frictionally hold a metal fastener, such as a nail or screw, therein, thus providing the "strapping" for a wall system that provides an attachment point for gypsum board (not shown), interior or exterior wall cladding (not shown), or other interior or exterior siding (not shown). Thus, the web members 40 function to align the side panels 20, hold the side panels 20 in place during a concrete pour, and provide strapping to connect siding and the like to the formed concrete wall 10.

Referring again to FIG. 1, one skilled in the art will appreciate that a plurality of side panels 20 can be longitudinally aligned to form a predetermined length and be vertically stacked to form a predetermined height. For example, as shown in FIG. 1, the first end 28 of one side panel 20 abuts the second end 30 of another side panel 20 and the bottom end 26 of one side panel 20 is disposed on the top end 24 of another side panel 20. Thus, a series of side panels 20 can be aligned and stacked to form the concrete system 10 into which concrete C is poured to complete the construction of the wall 10. One consideration, however, is that the side panels 20 are not vertically stacked too high and filled at once so that the pressure on the bottom side panel 20 is greater than the yield strength of the web members 40 or EPS side panels 20. Instead, the stacked wall of panels 20 can be filled and cured in stages so that the static and dynamic pressures are not excessive on the lower side panels 20.

To facilitate the stacking of the components, the side panels 20 are optionally provided with a series of projections 35 and indentations 37 that complementarily receive offset projections 35 and indentations 37 from another side panel 20 (i.e., a tongue-and-groove-type system). The projections 35 and indentations 37 in the adjacent side panels 20 mate with each other to form a tight seal that prevents leakage of concrete C during wall formation and prevents loss of energy through the formed wall.

Referring still to FIG. 1 for the first embodiment of the present invention, the present invention also uses corner sections 39. Preferably, each corner section 39 forms a substantially right angle and concrete C is also poured into the corner section similar to the other sections of the concrete form system 10. Forty-five degree angle corner sections can also be used. Thus, the formed concrete wall is contiguous for maximum strength, as opposed to being separately connected blocks. Still another embodiment of the present invention, which is not shown, uses non-linear side panels so that the formed wall has curvature instead of being straight.

The first embodiment of the present invention is an improvement over the prior art. Although other systems may use connector elements, the prior art lacks a web member 40 having an end plate 42, which provides a nailing/screwing strip adjacent the exterior surface 32 of the side panel 20, and has an attachment point 44 or similar connection projecting into the cavity 38 adjacent the interior surface 34. Moreover, the present invention uses less plastic and is, therefore, less expensive to manufacture.

Furthermore, in prior art systems, the panels are made so that large, thick, plastic connector elements slide down in a "T" slot formed within the inside surface of the panel itself. These prior art designs are structurally weaker and the construction workers in the field have substantial difficulty avoiding breaking the panels while sliding the connector element into place. Additionally, the prior art panels can break off from the cured concrete if any "pulling" occurs while mounting sheetrock or other materials onto the outer side of the panel. The preferred embodiment of the present invention having the web member 40 integrally formed into the side panel 20 provides a stronger "interlocking" system among the side panels 20, the web member 40, and the connectors 50, which are imbedded within concrete in the cavity 38. Nonetheless, as mentioned above, it is contemplated within the scope of the present invention using web members 40 that are not integrally formed into the side panels 20.

Now moving to the second embodiment of the present invention, as noted above, there are three methods of constructing the tilt-up walls 10 of the present invention: (1) pouring the concrete and then inserting the panel 20 into the poured concrete, which is also known as "wet-setting" and is shown in FIG. 7; (2) pouring the concrete onto a substantially horizontally-disposed side panel 20, which is shown in FIG. 8; or (3) pouring the concrete onto a substantially horizontally-disposed side panel 20 and then inserting the panel 20 into the top surface of the poured concrete so that the concrete is "sandwiched" between two opposed side panels 20 and, when erected, appears the same as the wall 10 formed by the first embodiment shown in FIG. 2A. All of the walls 10 formed by these three methods or designs are known as tilt-up walls.

As noted, the first two designs of the second embodiment use a side panel 20 on only one side of the formed concrete structure 10, unlike the third design that uses opposed side panels covering both faces of the concrete C. Thus, the walls 10 formed by the first two designs of this embodiment are insulated on one side, which may be either the interior or exterior of the wall. Leaving the external surface as a concrete surface without a side panel is advantageous for insect control, such as preventing termite infestation since termites cannot burrow through concrete C, but may attack and bore through EPS—the preferred material to form the side panels 20. Alternatively, leaving the interior surface as a concrete surface is advantageous for warehouses in which fork lifts, for example, could potentially damage any interior finishes by forcefully contacting them, whereas a concrete surface subjected to the same contact will remain substantially unimpaired. The side panels 20 may extend the full or a partial height of the tilt-up wall and, as discussed above, provide both sound impedance and thermal insulation.

For the wet-setting method shown in FIG. 7, it is preferred that a concrete floor slab (not shown), which will serve as a casting base for the tilt-up walls, is formed on a prepared, well-compacted subbase. It has been found that a five-inch (5") or thicker slab is desired. Also, instead of forming the entire floor during the initial pouring, the slab is typically held back several feet from its ultimate perimeter dimension (i.e., the interior boundaries of the building) to allow space for raising and setting the tilt-up walls after being formed on the floor slab. As discussed below, the gap that exists is subsequently filled in after the tilt-up walls are later erected.

After the floor slab cures, the perimeter foundations or forms (not shown) within which the concrete is poured for forming the tilt-up walls are next positioned and braced to form a substantially contained volume. The perimeter forms are often dimension lumber of sufficient width to allow the walls to be made the desired thickness. Once the periphery forms are in place, door and window openings are blocked out and set. One skilled in the art will also appreciate that reinforcement, typically re-bar, is also positioned within the perimeter forms to be contained within the interior of the tilt-up wall after the concrete is poured. Likewise, items to be embedded within the tilt-up wall, such as for attachments for the lifting cables (discussed below), are also positioned within the perimeter forms.

Concurrently, the side panels 20 are sized and interconnected to match (or, if desired, be smaller than) the length and width dimensions of the tilt-up sections to be cast. Specifically, the side panels 20 are joined together using the projections 35 and indentations 37 (i.e., tongue-and-groove-type connectors) so that a top end 24 of one panel 20 abuts a bottom end 26 of another panel 20 and/or a first end 28 of one panel 20 abuts a second end 30 of another. The side panels 20 are usually joined in a side-by-side configuration while they are horizontally oriented.

The assembled side panels 20 forming an array of panels are preferably fastened together using strongbacks (not shown), which are often a metal "C"-shaped channel or similar device that provides stiffness to the array. Screws are typically used to interconnect the end plates 42 of the web members 40 to the strongbacks, which run the entire height or length of the assembled array of panels 20.

Either before or after fastening the array of panels together, the side panels 20 are cut not only for height and width dimensions, but also for any penetrations to be included within the tilt-up wall (i.e., windows and doorways), embedded items, and welding plates. The assembled panels with strongbacks are then staged to be "wet set" after consolidation and screeding of the concrete.

With the preliminary steps completed, a release agent is sprayed or poured onto the concrete floor slab or other surface used, if not completed earlier. The fluid concrete is then poured into the perimeter foundations (or other substantially contained volume) and leveled or screeded. The side panels 20 are then "wet set," in which the interior surface 34 of the side panels 20 are oriented downwardly and pressed firmly into the wet concrete so that a portion of the interior surface 34 of the side panel 20 contacts or is adjacent to the upper surface of the poured concrete.

Two men can easily lift each array of panels, which may measure, in an example construction, four feet by twenty feet. In such an example, each array may be formed of panels abutting end to end 28, 30 and five arrays of side panels 20 may be coupled together top end 24 to bottom end 26 to form a surface that is twenty feet by twenty feet. If necessary, small "fill-in" pieces of the side panels 20 are easily installed by hand after the arrays of panels are positioned. Compared to insulation mounted onto a tilt-up wall after the concrete slab C has cured, these contiguous, interlocked side panels 20 of the present invention provide superior insulation over systems that have breaks (i.e., at the location of a ferring member) and are significantly less expensive to install.

In the preferred embodiment, each side panel 20 in the array of panels measures sixteen inches by forty-eight inches (16"×48") and has thirty (30) attachment points 44 that penetrate into the concrete C forming the tilt-up wall. Thus, there are 5.6 penetrations per square foot of wall surface area. If it is believed that the attachment points 44 will not provide a sufficient bond to the concrete C, then stanchions can be used, which are discussed below and some of which are shown in FIG. 6.

When the side panels 20 are firmly pressed into the wet cement, the attachment points 44 penetrate into the wet concrete. A stinger vibrator (not shown) or the like may also be used on the strongbacks or side panels 20 to aid in the consolidation of the concrete around the attachment points 44. After setting the side panels 20, the strongbacks are removed so that the tilt-up system 10 is complete and ready for curing. Once the poured concrete substantially cures and forms a concrete slab C, that slab maintains its relative position against the interior surface 34 of the side panel 20 by the attachment points 44. That is, by projecting beyond the interior surface 34 of the side panel 20, the web members 40 anchor the side panel 20 to the concrete slab C so that the concrete slab C and side panel 20 form the tilt-up concrete structure 10 of the present invention. After the concrete slab C is substantially cured, the formed concrete structure 10 is tilted up, as discussed below and shown generally in FIG. 11.

Referring again to FIG. 7 generally illustrating the wet-setting construction method of the tilt-up walls, one skilled in the art will appreciate that this process has specific benefits. First, the side panels 20 that are disposed over the concrete—which may be performed within ten minutes of pouring—can act as a barrier to the ambient environment. The less temperate the ambient conditions, the more beneficial the wet-setting method using the side panels 20 positioned over the wet concrete. For example, in hot conditions, the side panels 20 retard evaporation so that a slower "wet cure" of the concrete occurs and the formed tilt-up wall is stronger based on the curing process. Without using the side panels 20 of the present invention, either the moisture evaporates too quickly resulting in a structurally weaker concrete or, more typically, a sealing membrane or "retardant" is sprayed over the top of the fluid concrete after screeding and leveling—an expense that is not incurred using the wet-setting process of the present invention. Alternatively, if the ambient environment is cold (i.e., close to or below freezing conditions), the side panels 20 also facilitate curing by including an insulating layer. Without using the wet-setting process of the present invention, the prior art techniques have involved using tents with propane blowers, blanketing the top surface of the concrete, or heating the area around the poured tilt-up wall using other means known in the art. The present invention is advantageous because it avoids or reduces the labor, fuel, and equipment costs associated with heating the concrete as it cures. Another advantage of the wet-setting method is that irregularities in the upper surface of the concrete after pouring are acceptable. That is, the poured concrete should be leveled within plus or minus one quarter inch (±¼") before placing the side panels 20 into the concrete. Accordingly, the process of using a power trowel, which is labor intensive and can be expensive, is most likely avoided. Therefore, the wet-setting method circumvents the need for curing compounds, power trowels or other surface finishing, and curing thermal blankets or other heating processes.

For the second method of forming the tilt-up walls shown generally in FIG. 8, the side panel 20 is horizontally-disposed so that the attachment points 44 extend upwardly (i.e., opposite to the orientation of the wet-setting embodiment). The interior surface 34 of the side panel 20 becomes the surface onto which concrete is poured. Perimeter forms (not shown) are placed around the of the periphery, namely, the top end 24, bottom end 26, first end 28, and second end 30 of one side panel 20 or an array of side panels 20, to prevent the fluid concrete from leaking off of the interior surface 34. Furthermore, as discussed below if a connector 50 is used as a stanchion instead of other exemplary embodiments shown in FIG. 6, re-bar can be positioned within the apertures 56 to strengthen the tilt-up wall prior to pouring the concrete. Once the concrete is poured, leveled, and substantially cured, the forms are removed and the side panel 20 and substantially cured concrete slab C creates the tilt-up wall 10. The second method of forming a tilt-up wall advantageously avoids use of a release agent. Also, one skilled in the art will appreciate that the term "a side panel" as used for the second and third designs may encompass multiple panels, including an array of panels discussed above for the first design.

The third method or design of forming the tilt-up wall repeats first steps used in the second design, namely, the side panel 20 is horizontally-disposed so that the attachment points 44 extend upwardly; perimeter forms are placed around the of the periphery of the side panel 20; and the concrete is poured. However, before the concrete cures to any substantial degree, another, second side panel 20 is wet set into the poured concrete, as occurs in the first design. Thus, the third method is a hybrid of the first two methods to create a wall 10 that, when substantially cured and tilted up, has the design shown in FIG. 2A. As will be appreciated, the interior surfaces 34 of the opposed side panels 20 and the web members 40 disposed therein are spaced apart in a non-contacting relationship with each other so that the first and second side panels are stationarily positioned relative to each other by only the concrete slab C disposed within the cavity 38. That is, unlike the first embodiment shown in FIG. 2, there are no connectors 50 or other components interconnecting the opposed side panels 20.

This third method of making a tilt-up wall 10 has many advantages. When considered to prior art tilt-up walls, it encompasses the same advantages of both the first and second methods of forming a tilt-up wall, such as avoiding the need for (1) curing thermal blankets or other heating processes, (2) curing compounds, (3) power trowels or other surface finishing, and (4) a release agent. This third design also has greater insulating value and sound impedance than either of the first two designs since there are side panels 20 on each side of the concrete slab C, instead on only on one side.

The third embodiment also has potential advantages over the first embodiment of the present invention, which is shown in FIGS. 1 and 2, particularly if the wall being formed is greater than one story high. Most obviously, this dual-panel tilt-up wall form using the third design does not use connectors so there is a cost savings both by avoiding the purchase of these components and by not requiring the labor to install the connectors to interconnect the side panels. In addition, for a wall greater than one story high, the cost of external bracing and scaffolding during the wall assembly and pouring of concrete is not required. Since the panels 20 are laid flat during pouring of the concrete, there are minimal hydrostatic pressures compared to the panels being erected before pouring. As one skilled in the art will further appreciate, the practice of forming a wall as shown in the first embodiment typically involves filling in the cavities in four foot vertical increments, called lifts. The process of forming each lift is more labor intensive than filling the cavity continuously at a single horizontal location. Furthermore, it is imprudent—and prohibited by some building codes—to drop concrete more than ten feet because the constituents of the concrete tend to separate from each other, resulting in a weak final product. Thus, the usual practice in vertical-wall formation is to cut holes into the side panels at different elevational positions and then patch the holes after they are used as a filling port between the source of concrete and the cavity. This process of using the holes in the side panels, obviously, increases the labor costs and time required to fill the cavity for a wall greater than one story in height. The third design of the tilt-up wall, in comparison, avoids these problems and, accordingly, is quicker and less expensive to construct than the first embodiment of the dual-panel wall for wall structures greater than one story in height.

Figure 11:
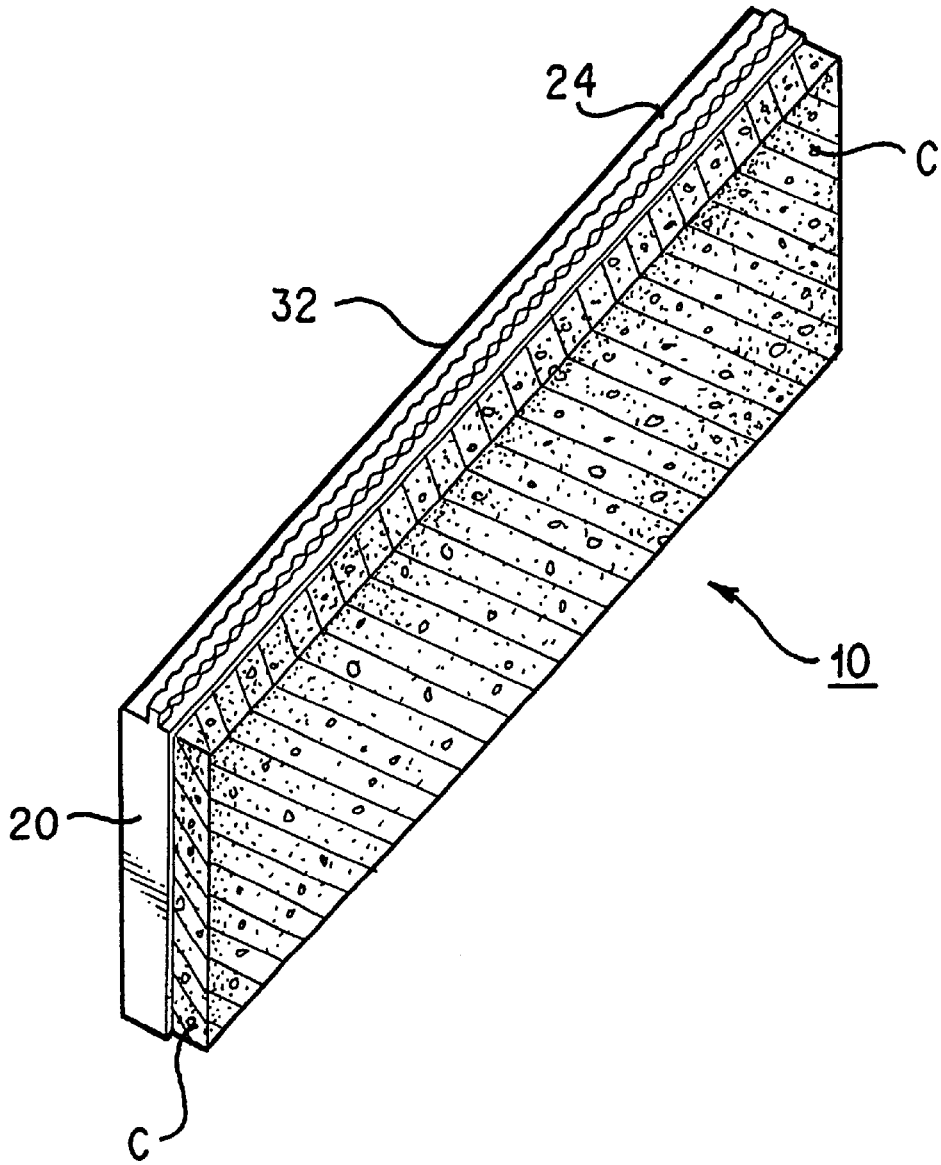
FIG. 11 is a perspective view of an upstanding concrete structure formed by two of the second embodiments or the third embodiment of the present invention, which are shown in FIGS. 7, 8, 9, and 9A.

Regardless of the method used to form the tilt-up walls of the present invention, the side panels 20—either with or without the stanchions connected—forge a bond with the concrete as it cures. Once the concrete C obtains sufficient strength for lifting (usually 2,500–3,000 psi) that is typically reached in five to ten days (depending on ambient conditions), a crane (not shown) or other means connects to cables (not shown) attached to embedded inserts cast into the tilt-up wall. The crane sequentially lifts each tilt-up wall and sets it on a prepared foundation around the building perimeter. FIG. 11 shows a single concrete structure 10 having been tilted up. Before any of the tilt-up walls are released by the crane, temporary braces (not shown) are installed—at least two per tilt-up wall—to brace up the respective tilt-up walls until the roof structure is attached.

Next, connections between individual tilt-up walls are made, which usually entail welding splices of steel ledger angles (not shown), and then the joints between the tilt-up walls (typically three-quarter inch (¾")) are caulked. Also, any necessary patching is made to repair blemishes. Approximately the same time, the closure strip between the tilt-up walls and the floor slab (usually a two-foot-wide strip) is filled with concrete and the bracing is removed when the roof has been permanently connected to the tilt-up walls.

One of the advantages of using tilt-up walls 10 of the present invention is the shortened construction time. All of the steps discussed above in forming a building frame, from pouring the floor slab to erecting the tilt-up walls that are ready to receive the roof structure, often require only four weeks. Tilt-up walls are also generally less labor intensive to construct, which results in a financial savings. Moreover, tilt-up walls 10 of the present invention may be used to form multi-story buildings.

When considering the benefits of using the side panels 20 with tilt-up walls, one skilled will appreciate the improved insulation and sound impedance that exists using the side panels 20, which would be difficult and expensive to install on a conventional tilt-up wall once erected. Also, the web members 40, when set into the concrete and substantially cured, insure a substantially permanent, worry-free connection for the side panels 20 and provide a solid attachment point that may be used to connect wallboard such as sheet rock, brick, or stone finishes. Moreover, electrical and plumbing runs are easily installed within the side panels 20. That is, installing electrical and plumbing is accomplished by cutting the "run's" using a hot knife, router, or electric chain saw into the side panel 20 of preferred embodiment, which is made of EPS. Also, using the preferred side panels 20 removes any potential metal contact problems and makes it much easier to connect pipes and wires compared to achieving the same with conventional tilt-up walls.

The tilt-up wall concrete structure 10 using a side panel 20 on only one side of the concrete slab C can also be used as an insulated concrete floor, in which the panels are formed and raised upwardly to form a floor of the building. Likewise, the structure 10 can also be used to create roof panels. Thus, the present invention can be used to construct the majority of an entire building, namely, the walls, floors/ceilings, and roof panels. Also of note, the side panels 20 do not affect the engineered structural design of the formed tilt-up wall as compared to not using the panels.

If the concrete or "slump" is dry or if ambient conditions are cold, the attachment points 44—being rectangular and substantially flat and extending eleven-sixteenths (11/16) of an inch from the interior surface 34 of the side panel 20 in the preferred embodiment—may have difficulty penetrating into the fluid concrete. The present invention, as mentioned above, includes stanchions or extending devices that assist in bonding the side panels 20 to the wet concrete. The primary function of the stanchions is to form better bonds between the concrete C and the side panel 20. As such, the side panels 20 are less likely to separate from the concrete slab C of the tilt-up wall or other wall of the present invention throughout its life. A secondary function of the stanchions is to give greater structural integrity to the side panels 20 and associated wallboard, brick, or stone finishes attached to the end plates 42 of the web members 40. That is, by being more firmly anchored, the concrete slab C provides a better connection to the side panels 20 and a stronger foundation for any materials hung from the side panels 20. The stanchions are discussed in the specific context of a tilt-up wall but, as one skilled in the art will appreciate, the stanchions, for example, may also be useful in a dual-panel wall discussed above to buttress the connection between the side panel 20 and the concrete poured into the cavity 38.

One specific embodiment of the stanchion comprises a connector 50, for example, coupled to one attachment point 44 to increase the surface area to which the concrete C bonds. If the connectors 50 are the incorrect length, then they can easily be cut to the proper dimension at the construction site. The connectors 50, as discussed above, are best shown in FIGS. 4 and 4A.

Two additional such stanchions are shown in FIG. 6, namely, an extender 60 and a tilt-up anchor 70. First addressing the extender 60, it includes a tip end 62, an opposed base end 64, and a body 66 extending therebetween. Preferably, the tip end 62 is of a size to complementarily engage one end 52 of a connector 50 and the base end 64 is of a size to complementarily engage one attachment point 44. Similar to the preferred designs discussed above, the tip end 62 is preferably rectangular in plan view—as is the attachment point 44—and the base end 64 preferably defines a track of a size to slidably receive a selected one of the tip end 62 or the attachment point 44 therein—as does one end 52 of the connector 50. The locking means is preferably also part of the extender 60 and other stanchions.

The body 66 of the extender 60 is preferably non-smooth, which assists in bonding to concrete C. In the preferred embodiment, the body 66 defines a passage 68 therethrough. As will be noted by FIGS. 6 and 12, the passage 68 has a substantially rectangular cross-section. In the preferred embodiment, the width of the sides of the passage 68 is between one-quarter (¼) and one (1) inch to have a cross-sectional area between approximately 0.125 and 1 square inches, and more preferably between one-half (½) inch and three-quarter (¾) inch to have a cross-sectional area between approximately 0.25 and 0.57 square inches. This range of widths allows a portion of a flexible linking member 90 (shown in FIG. 12) to be received therethrough (as discussed below) as well as being of a dimension to allow fluid concrete to at least partially flow into the passage 68 for better bonding. Of course, other dimensions are contemplated to achieve these same functions and, in fact, the minimal dimension to allow fluid concrete to flow partially therein may be a function of the viscosity of the fluid concrete and size of the aggregate stone used. Likewise, other cross-sectional shapes for the passage 68 are also contemplated, such as circular, elliptical, triangular, or other polygonal shapes. As one skilled in the art will also appreciate, the body 66 of the extender 60 can be manufactured in different lengths, depending on the use of the extender 60; however, the preferred length between the tip end 62 and the base end 64 is approximately one inch.

Three functions of the extender 60 of the present invention are addressed herein: (1) as a stanchion; (2) as an extension for the connectors 50; and (3) as part of a connection between side panels 20 or to buttress the connection between panels 20. The first listed function of extender 60 is the same as the other stanchions, which is to provide an additional surface to which the concrete can bond while curing to form a stronger connection with the side panel 20. The extender 60 connects to one respective attachment point 44 of the web member 40 and extends into the concrete C a greater distance than the attachment point 44. This longer extension, in and of itself, strengthens the bond between the concrete C and the side panel 20 to which the extender 60 is connected since there is more surface area to which the concrete C may bond during curing. Moreover, this bond is further strengthened by the extender 60 in the preferred embodiment having a non-smooth surface and, in the preferred embodiment, the non-smooth surface resulting in part from the passage 68 extending therethrough. As mentioned above, the passage 68 is preferably of a dimension to allow fluid concrete to at least partially flow therein, which enhances the bond with concrete C.

The second listed function of the extender 60 is to extend the reach of the connectors 50. As discussed above, it is preferred to make the connectors 50 having lengths so that the width of the cavity 38 is two (2), four (4), six (6), eight (8) inches or greater. If, however, it is desired to have the width of the cavity 38 be three (3), five (5), or seven (7) inches, then the preferred embodiment of the extender 60 could be used to obtain that extra inch of separation.

Assume, for example, that the connector 50 shown in FIGS. 4 and 4A connects to the two attachment points 44 of opposed side panels 20 in the dual-panel embodiment (which is discussed above and shown in FIGS. 1 and 2) to form a cavity 38 that is two inches wide. To increase the width of the cavity 38 to be three inches wide, the preferred extender 60 is used in conjunction with the connector 50 shown in FIG. 4 or FIG. 4A. That is, the tip end 62 of the extender 60 is preferably formed to be the same dimensions as an attachment point 44 of the web member 40 so that the tip end 62 can be slidably received into the track 54 at one end 52 of the connector 50, similar to the attachment point 44 being slidably received into the end 52 of the connector 50. The base end 64 of the extender 60, in conjunction, preferably forms a track into which one attachment point 44 of a web member 40 is slidably received (i.e., the same dimension as the track 54 of the connector 50 shown in FIG. 4 or FIG. 4A). Accordingly, the connector 50 is coupled to the attachment point 44 of one side panel 20, the base end 64 of the extender 60 is coupled to the attachment point 44 of the opposed side panel 20, and the connector 50 is attached to the tip end 62 of the extender 60 so that a three-inch wide cavity 38 is formed between two opposed side panels 20, instead of a two-inch cavity if the connector 50 shown in FIG. 4 or FIG. 4A was used alone. Thus, in the preferred embodiment, for each extender 60 added between the connector 50 and the attachment point 44, the extender 60 advantageously allows the cavity 38 to be extended one inch in width. As such, the extender 60 can be used to meet this need to have an irregularly sized cavity without requiring the manufacturer to mold special new connectors, which would be an expensive endeavor. As one skilled in the art will appreciate, the extender 60 can have a length other than one inch, if desired.

Figure 13:
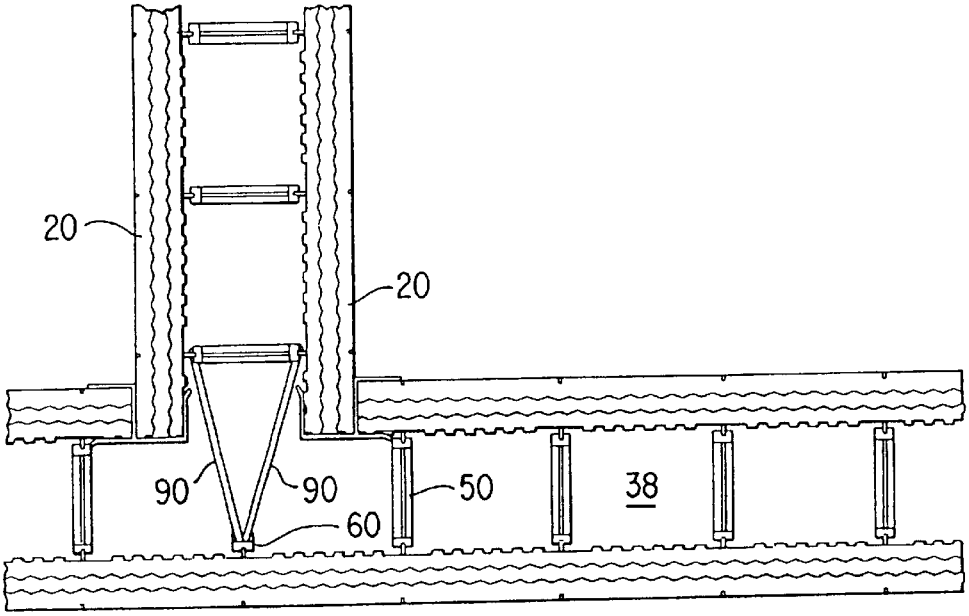
FIG. 13 is a top plan view of a T-wall formed, in part, using flexible linking members.

The third potential function of the extender 60 is to establish or to buttress the connection between side panels 20. One example in which the extender 60 is beneficial when one wall or panel is at a non-parallel angle to another wall or panel, often being disposed at right angles to form a T-wall in top plan view, which is shown in FIG. 13. Since concrete has to be poured into the cavity 38 defined by the side panels 20 that are not oriented parallel to each other (as exists in FIG. 2), the normally linear connectors 50 shown in FIGS. 4 and 4A cannot feasibly be used. As one skilled in the art will appreciate, although within the scope of the present invention, manufacturing non-linear connectors would be expensive and often not be viable for a large percentage of construction projects.

In conjunction, one problem with constructing such a T-wall is that when the concrete is poured into the cavity 38, pressures against the abutting side panel 20 (i.e., at the top of the "T") forces the side panel outwardly. The prior art solution is to brace the wall on the exterior surface 32 of the side panel 20 using, for example, lumber braces. The braces, however, are difficult and labor intensive to construct, particularly when used on multistory building above the first or ground floor.

Figure 12:
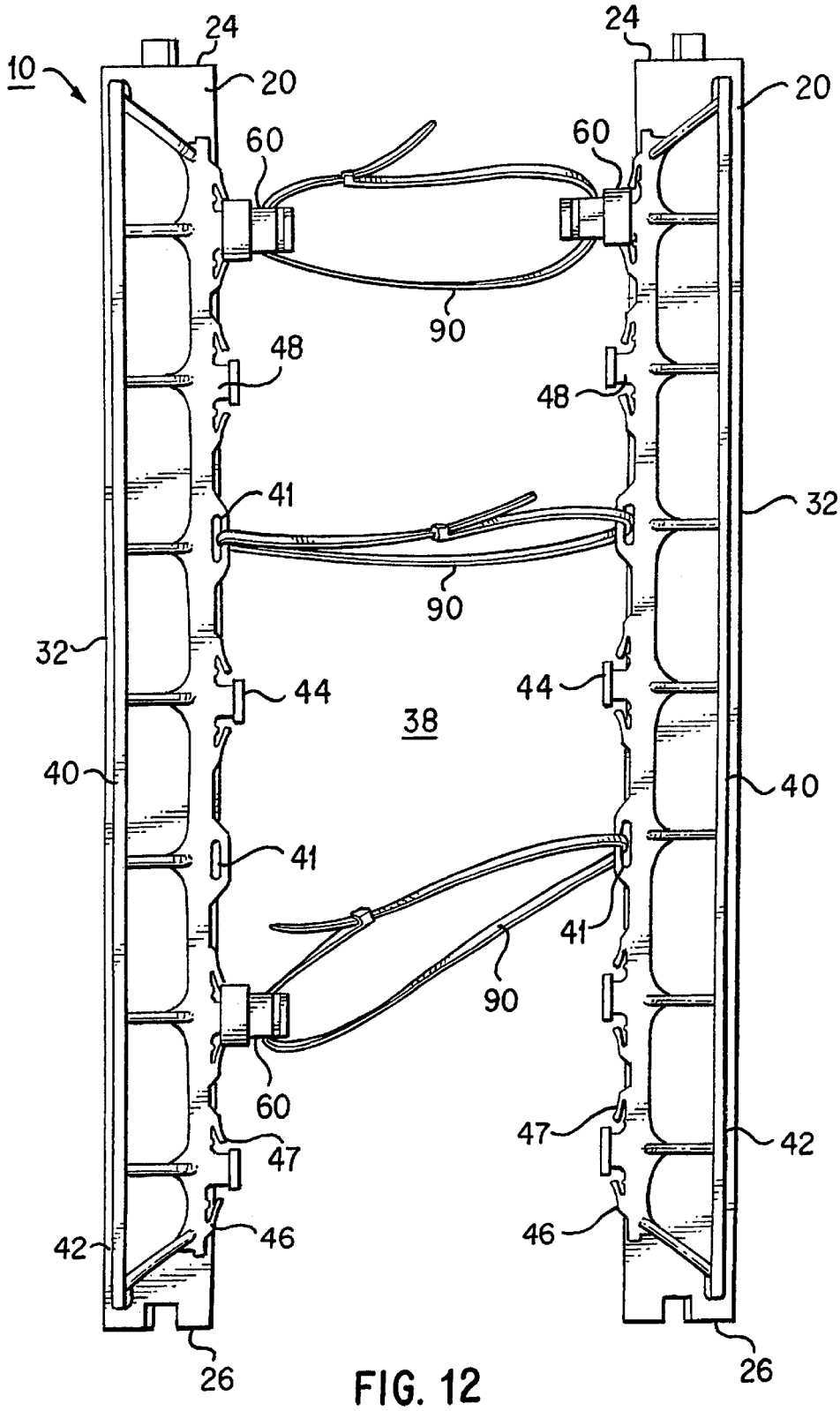
FIG. 12 is a cross-sectional side view showing two opposed side panels and the web members partially disposed therein, in which the side panels are interconnected in various combinations by flexible linking members joining extenders or slots formed into the web members.

Referring now to FIG. 12, the extender 60, used with a flexible linking member 90, such as a zip-tie, plastic tie strap, tie wire, or other similar component, provides an easy and effective solution to buttress a connection between side panels 20, particularly for situations in which the respective interior surfaces 34 are not parallel to each other. Although not required, it is preferred that the flexible linking member 90 be contiguous and connect to itself in by forming a closed loop, in which the looped linking member 90 interconnects the opposed side panels 20.

For one design shown at the top of FIG. 12, respective extenders 60 are connected to attachment points 44 formed on different side panels 20. That is, in this design there are two extenders: a first extender 60 connected to the attachment point 44 of one web member 40 partially disposed within a first panel 20 and a second extender 60 connected to the attachment point 44 of one web member 40 partially disposed within the opposed second panel 20. A portion of the flexible linking member 90, in conjunction, traverses through the passage of the first extender 60 and a portion of the flexible linking member 90 also traverses through the passage of the second extender 60. The flexible linking member 90 is connected through the respective passages of two extenders 60 and tightened, thereby securely interconnecting the spaced-apart panels 20.

In another embodiment, it is also contemplated that at least one of the two web members 40 defines a slot 41 extending therethrough. The slot 41 is preferably located adjacent the interior surface 34 of the first panel in which the web member 40 is disposed and preferably integrally formed with the web member 40. The slot 41 is also preferably of a size to receive a portion of the flexible linking member 90 therein. Thus, as shown at the bottom of FIG. 12, a portion of the flexible linking member 90 traverses through the slot 41 of one web member 40 and also traverses through the extender 60 connected to the attachment point 44 of the other web member 40 to interconnect the spaced-apart panels 20. In still another embodiment shown at the middle of FIG. 12, a portion of the flexible linking member 90 traverses through the slot 41 of one web member 40 and the slot 41 of the other web member 40 to interconnect the spaced-apart panels 20. The three illustrated embodiments shown in FIG. 12, of course, may be used independently of each other.

Similarly, the extender 60 with the flexible linking members 90 can be used anywhere on the side panels 20 where there may be weakness in the structure. As an example, weakness may exist where a cut-up design is used or the wall zig-zags. As another example, weakness may also occur wherever quick turns are used in the layout of the side panel 20. In these situations, the extenders 60 and interconnecting flexible linking members 90 may be used in lieu of external bracing. Although not preferred, it is also contemplated that the flexible linking member 90—in concert with the passages 68 of extenders 60 or the slots 41 formed into the web members 40—may interconnect opposed side panels 20 in the first embodiment (shown, for example, in FIGS. 1 and 2), instead of using connectors 50 to interconnect the side panels 20.

In comparison to the extender 60, another design of the stanchion, the anchor 70, is also shown in FIG. 6 and is less broad in its potential functional uses. The primary purpose of the anchor 70 is to strengthen the bond between the side panel 20 and the adjacent concrete once that concrete has substantially cured. The preferred anchor 70 has a forward end 72, an opposed back end 74, and a body 76 extending therebetween. The back end 74 is preferably of a size to complementarily engage one attachment point 44.

Also, it is preferred that the body 76 has at least one prong 78 extending from it and, more preferably, two prongs 78 oriented co-linearly to each other. However, as one skilled in the art will appreciate, other permutations also fall within the scope of the present invention, such as three or more prongs 78 or two prongs 78 not oriented co-linearly. The presently preferred prongs 78 have a length of a half (½) inch to one (1) inch and a generally round cross-sectional shape that has a diameter of one quarter (¼) inch. One skilled in the art, however, will appreciate that wider range of values are possible for the prongs 78—the important consideration being that the prongs 78 not break when fluid concrete flows past the anchor 70 during the construction process or after substantial curing. Also, the prongs 78 can be integrally formed to the anchor 70 or coupled thereto using any means known in the art.

Returning to the presently preferred embodiment of two co-linear prongs 78, it is preferred that when the anchor 70 is connected to the attachment point 44, the two prongs 78 form an angle that is not perpendicular or normal to a plane formed by the interior surface 34 of the side panel 20 (and also the plane formed by the exterior surface of the concrete C on the tilt-up wall). In fact, it is most preferred that the two prongs 78 extend parallel to the plane formed by the interior surface 34 of the side panel 20 to which the anchor 70 is attached, an angle which is generally perpendicular to the direction that the anchor 70 extends between its forward and back ends 72, 74 when connected to the attachment point 44. This angular orientation of the prongs 78 provides increased bonding strength with the concrete C.

Although it is presently preferred that there is at least one prong 78, the present invention contemplates that no prongs be included; instead, the body 76 of the anchor 70 can be of a non-smooth or non-linear shape to bond with the fluid concrete that flows around the body 76. One contemplated design includes a generally mushroom shape that is narrow at the back end 74 and flares outwardly moving toward the forward end 72. Other contemplated designs include the forward and back ends 72, 74 being wider in side view than the intervening portion of the body 76 so that the body appears similar to a chef's hat or an hourglass in side view. Of course, symmetry is not required in any of these alternative embodiments. As one skilled in the art will appreciate, one important consideration is that the fluid concrete be able to flow around the anchor 70 to improve bonding after the concrete substantially cures.

Although the length of the connector 50, extender 60, or anchor 70 used as a stanchion between the interior surface 34 of the side panel 20 and the tip of the stanchion may be any dimension shorter than the thickness of the concrete portion of the tilt-up wall, the preferred embodiment uses a length of one inch (1") or less. The reason for using a length shorter than the possible maximum length is that a longer stanchion would potentially interface with the re-bar or other structural support within the tilt-up wall. That is, either by convention or as required by applicable building code requirements, the re-bar is usually placed one inch or more away from either surface of the tilt-up wall so that the ends of the respective stanchions, extending the maximum of one inch, will not interface with or contact the re-bar, which could impede the proper setting of the side panels 20 into the fluid concrete.

As with the connectors 50, the other embodiments of the stanchions are preferably formed of a high-density plastic, such as high-density polyethylene or polypropylene, although other polymers can be used as noted above. Advantages of the high-density plastics for the stanchions include cost of manufacturing, strength, rigidity when the component is sufficiently thick, and the like.

As one skilled in the art will also appreciate, the stanchions are not necessary for the present invention to function and, in fact, may not even be desired if the concrete is very "wet" or a plasticizer has been added to the concrete in the context of constructing tilt-up walls. If stanchions are used, it is contemplated using one stanchion per web member 40 connected to the center attachment point 44 (i.e., the middle attachment point 44 shown in FIG. 6); however, it is also contemplated using up to and including one stanchion on each attachment point 44 (i.e., five stanchions used on every web member in the embodiment shown in FIG. 6).

Referring now to FIGS. 9 and 9A, the third embodiment of the present invention is analogous to the first embodiment because a cavity is formed into which concrete is poured. However, instead of the formed concrete structure having opposed side panels 20 each connected to the concrete portion as in the first embodiment shown in FIGS. 2 and 2A, this embodiment preferably uses a side panel 20 on only one side of the formed concrete structure 10. That is, the formed concrete structure 10 is similar to the tilt-up wall discussed above (i.e., a concrete slab C with side panels 20 positioned only on one side), but is made using a different construction process.

More specifically and as best shown in FIG. 9, the third embodiment uses a side panel 20 and an opposed sheet 80 to form the cavity 38 into which the concrete is poured. That is, in forming the wall 10, the process involves positioning the side panel 20 and the sheet 80 substantially upright so that a portion of the interior surface 34 of the side panel 20 faces a portion of an inside surface 82 of the sheet 80. The interior surface 34 and the inside surface 82 are laterally spaced apart from each other so that a cavity 38 is formed therebetween, just as occurs in the first embodiment using spaced-apart side panels 20.

The sheet 80 is preferably plywood, but can be any solid material that can be coupled to either a web member 40 or a connector 50 and can withstand the forces exerted by the fluid concrete when poured into the cavity 38 without substantial bowing, warping, breaking, or other type of failure. Other contemplated materials include combined steel frame and plywood center, commonly known as a steel-ply panel. Accordingly, the sheet 80 functions as a form or barrier while the concrete is curing.

The process next involves attaching one end 52 ("the first end") of the connector 50 to the attachment point 44 of the side panel 20 and connecting a portion of the inside surface 82 of the sheet 80 to the other end 52 ("the second end") of the connector 50. However, it may be a matter of preference for the order of construction so the first end of the connector 50 may be attached to the attachment point 44 before positioning the sheet 80 or the sheet may be positioned before the first end of the connector 50 is attached to the attachment point 44.

The sheet 80 can be either directly or indirectly coupled to the connector 50. That is, referring back to FIG. 3, there are two options for the second or "free end" of the connector 50, which is the end not attached to the web member 40 located within the side panel 20. First, for the indirect connection and as shown in FIG. 9, the free end can be connected to, for example, a stand-alone web member 40', which is a web member that is not formed within a side panel 20 and is illustrated in FIGS. 3, 6, 9, and 10. The sheet 80 is then connected to the end plate 42 of the stand-alone web member 40', instead of being directly connected to the second end of the connector. This indirect connection forms the preferred embodiment.

FIG. 3 shows only one stand-alone web member 40' that is attached to the connectors 50. As one skilled in the art will appreciate, however, multiple web members 40 are preferably used when preparing the wall structure 10 (i.e., between two and six stand-alone web members 40' used for the side panel 20 shown in FIG. 3 based on there being six web members 40 located within the side panel 20). It is, of course, preferred to use a sufficient number of web members to withstand the dynamic and static forces that exist when the fluid concrete is poured into the cavity (i.e., preferably six for the side panel 20 shown in FIGS. 3 and 9).

Alternatively and less preferred, the sheet 80 may be connected directly to the second or free end of the connector 50. Still referring to FIG. 3, four connectors 50 are shown in this configuration (i.e., connected to the web member 40 located within the side panel 20 but not connected to a stand-alone web member 40'). Thus, unlike the indirect connection having an intervening stand-alone web member 40' or other component, the sheet 80 in this design is directly coupled to the second ends of the connectors 50. The potential drawback with this design is that it is more difficult to attach or couple the sheet 80 to the connectors 50 at the construction site. However, if the free end of the connectors 50 is formed with more surface area than included in the illustrated embodiments, this potential drawback may be reduced.

It is also contemplated using connectors 50 that are integrally attached to or formed with the web members 40 located in the side panels 20 for the third embodiment (as well as other embodiments). Stated differently, the connectors 50 and web members 40 may be a unitary structure and, as such, the attachment points 44 in this contemplated design extend a distance from the interior surface 34 of the side panel 20 to the attachment points 44 that is substantially equivalent to the desired thickness of the cavity 38 for the direct connection process. Thus, the step of attaching the connectors 50 to the attachment points 44 of the web members 40 disposed within the side panels 20 is avoided because the inside surface 82 of the sheet 80 is attached directly to the attachment point 44 to form the cavity 38. Alternatively, the extended attachment points 44 may be designed to connect to the stand-alone web member 40' or similar structure is using the indirect connection method. However, this design of integrally forming the connectors 50 to the attachment points 44 has a potential drawback of the increased space needed to transport a given quantity of side panels 20 to the construction site if the web members 40 are integrally formed into the side panels 20, as opposed to being inserted through precut slots at the construction site.

Regardless of the component to which the sheet 80 is connected, it is preferred that the sheet be detachably connected, or removably attached, to the second end of the connector 50 or stand-alone web member 40'. By being detachably connected, the present invention entails that the sheet 80 can be removed from the end plate 42 or connector 50 substantially intact, preferably so that the sheet can be reused to form another concrete structure. Many means are contemplated for detachably coupling the sheet 80 to the end plate 42 or connector 50, such as using a nail or screw. One skilled in the art will appreciate that this list is not exhaustive and can include other coupling means such as chemical adhesives, rivets, tacks, nuts and bolts, and the like.

Once the sheet 80 and side panel 20 are interconnected and stationarily positioned relative to each other, the process of forming the structure 10 involves pouring fluid concrete into the cavity 38 and allowing the concrete to substantially cure to form a concrete slab C. The formed concrete structure 10 is shown in FIG. 9A. In the preferred embodiment, after the concrete substantially cures (which may take about three days depending on ambient conditions and the thickness of the cavity 38) the process involves removing the sheet 80 from the concrete slab C to expose a portion of the concrete slab C to atmosphere, which is shown in FIG. 11. That is, after substantially curing, the sheet 80 is preferably removed leaving a concrete structure 10 that has a side panel 20 disposed on one side and concrete C exposed to ambient or atmosphere on the other, opposed side. The sheet 80 is also preferably reusable for forming another wall. However, although not preferred, it is contemplated having the sheet 80 remain a permanent part of the tilt-up structure 10 as shown in FIG. 9A.

A potential aesthetic drawback with the above process is that when the sheet 80 is removed, the exposed surface will be predominately concrete C with the end plates 42 or the ends 52 of the connectors 50 recurrently showing on the exposed concrete surface. To avoid this non-contiguous appearance and as shown in FIG. 10, the present invention also contemplates using a spacer 84 attached or permanently affixed to the end plate 42 of the stand-alone web member 40' or to one end 52—the free or second end—of the connectors 50. The spacer 84 is to be disposed in a contacting relationship with the inside surface 82 of the sheet 80.

Referring now to FIG. 10, one embodiment of the spacer 84 is cone-shaped in side view, in which the narrow end is attached or coupled to the end plate 42 of the stand-alone web member 40' or the end 52 of the connector 50 and preferably extends between a quarter and three-quarter (¼–¾) inches, more preferably one-half (½) inch. The cone-shaped spacers may also be inverted so that the wide end is attached to the end plate 42. It is also contemplated that the cone-shaped spacer 84 has openings or slots extending between the narrow end and the wide end. Other shapes are contemplated for the spacer 84, such as circular, elliptical, or rectangular shapes in plan view. It is also contemplated having the spacer 84 use a constant cross-sectional area along its length, instead of being cone shaped.

The sheet 80 is mounted to abut the wide end of the spacer 84 and the screw—if used as the coupling means—traverses through the sheet 80, spacer 84, and then into and through a portion of either the end plate 42 of the stand-alone web member 40' or end 52 of the connector 50. If the wide end of the spacer 84 is attached to the end plate 42, then the coupling means need not traverse through the interior of the spacer, which may be easier at the construction site because less precise aligning is required. If the spacer 84 has openings, at least some concrete may enter into its internal volume when the cavity 38 is filled with concrete.

Using the spacers 84, after the concrete substantially cures and the sheet 80 is removed, the interior volume of the spacer 84 is exposed so that there are only small portions of the concrete surface in which the concrete C is not contiguous on the face of the structure 10. However, since the preferred spacer 84 is cone-shaped, a finish coat of cementitious material, including concrete, a parging coat, or stucco, can quickly be spread into the interior volume of the spacers so that when it cures, the exposed face of the concrete structure 10 appears as a uniform concrete surface, as opposed to having the ends 52 of the connectors 50 or the end plates 42 exposed.

One skilled in the art will appreciate that a uniform concrete appearance obtained using the spacers 84 is more aesthetically appealing if the exposed surface of the concrete structure remains exposed when the building is completed. However, if it is desired to mount materials such as drywall or masonry tiles directly onto the surface originally covered by the sheet 80, not using the spacers 84 may be preferred. That is, the exposed end plates 42 of the stand-alone web members 40' or the ends 52 of the connectors 50 facilitate attaching materials to the concrete surface because it is easier to connect materials to these members, compared to attaching the materials to the cured concrete C. Also, if the entire exposed concrete surface will be coated with stucco or the like, then depending on the bonding properties of the coating, it may be irrelevant whether the spacers 84 are used.

Although the present invention has been described with reference to specific details of certain embodiments thereof, it is not intended that such details should be regarded as limitations upon the scope of the invention except as and to the extent that they are included in the accompanying claims.

What is claimed is:

1. A form system, comprising:

a) first and second panels, each panel having an interior surface, wherein a portion of the interior surface of the first panel faces a portion of the interior surface of the second panel and wherein the interior surfaces are spaced apart from each other so that a cavity is formed therebetween;

b) a plurality of web members, each web member at least partially disposed within a respective one of the first and second panels so that a portion of each of the web members extends through the respective interior surfaces of the first panel and the second panel, wherein an attachment point is formed from a portion of each web member extending from the respective interior surfaces of the first and second panels, and wherein the attachment points are disposed within the cavity;

c) at least one connector, each connector having opposed ends, each end of a size to complementarily engage one respective attachment point; and d) an extender having a tip end and an opposed base end, the tip end of a size to complementarily engage one end of the connector and the base end of a size to complementarily engage one attachment point.

2. The form system of claim 1, wherein the attachment point of the web member and the tip end of the extender are substantially rectangular in plan view and wherein the ends of the connector each define a track of a size to slidably receive a selected one of the tip end or the attachment member therein.

3. The form system of claim 1, wherein the extender has a body extending between the tip and base ends thereof, the body being non-smooth.

4. The form system of claim 3, wherein the body of the extender defines a passage therethrough having a cross-sectional area of between approximately 0.25 and 0.57 square inches.

5. The form system of claim 3, wherein the body of the extender defines a passage therethrough of a dimension to allow fluid concrete to at least partially flow into the passage.

6. The form system of claim 1, wherein the extender is selected from a plurality of extenders, wherein at least two of the extenders have different lengths extending between their respective tip and the base ends.

7. The form system of claim 1, wherein the extender is constructed of high-density polypropylene or high-density polyethylene.

8. The form system of claim 1, wherein the extender has a length of approximately one inch between its tip and base ends.

9. The form system of claim 1, wherein the web member is integrally formed into the panel.

10. The form system of claim 1, wherein the web member is removably coupled to the panel.

11. The form system of claim 1, further comprising concrete disposed within the cavity and in contact with the interior surfaces of both the first and second panels.

12. A method of forming a concrete structure, comprising:

a) erecting first and second panels, each panel having an interior surface and at least one attachment point disposed adjacent the interior surface, the panels arranged in spaced parallel relationship with their interior surfaces facing each other so that a cavity is formed therebetween;

b) providing a connector having a first end and an opposed second end, wherein the first and second ends are each of a size to complementarily engage one respective attachment point;

c) engaging the first end of the connector with one attachment point of the first panel;

d) providing an extender having a tip end and an opposed base end, the tip end of a size to complementarily engage one end of the connector and the base end of a size to complementarily engage one attachment point;

e) connecting the second end of the connector to the tip end of the extender;

f) coupling the base end of the extender to one attachment point of the second panel so that the extender and the connector collectively span a desired lateral distance between the interior surfaces of the first and second panels, that desired distance corresponding to a width of the cavity; and g) pouring concrete into the cavity to be substantially cured.

13. A form system, comprising:

a) first and second panels, each panel having an interior surface, wherein a portion of the interior surface of the first panel is oriented toward a portion of the interior surface of the second panel and wherein the interior surfaces are spaced apart from each other;

b) a plurality of web members, each web member at least partially disposed within a respective one of the first and second panels so that a portion of each of the web members extends through the respective interior surfaces of the first panel and the second panel, wherein an attachment point is formed from a portion of each web member extending from the respective interior surfaces of the first and second panels;

c) at least one extender, each extender having a tip end, an opposed base end, and a body extending therebetween, the base end of a size to complementarily engage one attachment point of one web member, the body defining a passage therethrough; and d) at least one flexible linking member that interconnects the first and second side panels, wherein the flexible linking member is coupled to one web member partially disposed within the first panel and also couples to one web member partially disposed within the second panel, wherein, for at least one of the web members, the flexible linking member is coupled thereto by a portion of the flexible linking member traversing through the passage of one extender that has its base end connected to one attachment point of that web member.

14. The form system of claim 13, wherein there are two extenders, a first extender connected to the attachment point of one web member partially disposed within the first panel and a second extender connected to the attachment point of one web member partially disposed within the second panel, wherein a portion of the flexible linking member traverses through the passage of the first extender and a portion of the flexible linking member traverses through the passage of the second extender to interconnect the first and second panels.

15. The form system of claim 13, wherein at least one web member defines a slot extending therethrough, the slot located adjacent the interior surface of the panel in which the web member is disposed, the slot of a size to receive a portion of the flexible linking member therein, wherein a portion of the flexible linking member traverses through the slot of one web member and wherein another portion of the flexible linking member traverses through the passage of the extender connected to the attachment point of one web member to interconnect the first and second panels.

16. The form system of claim 13, wherein the interior surfaces of the first and second panels are positioned at a non-parallel orientation to each other.

17. The form system of claim 13, wherein the interior surfaces of the first and second panels are substantially parallel to each other.

18. The form system of claim 13, wherein the web member is integrally formed into the panel.

19. The form system of claim 13, wherein the web member is removably coupled to the panel.

20. The form system of claim 13, wherein the extender is constructed of high-density polypropylene or high-density polyethylene.

21. The form system of claim 13, further comprising contiguous concrete in contact with the interior surfaces of both the first and second panels.

22. The form system of claim 13, wherein the flexible linking member is contiguous and connects to itself to form a loop that is coupled to one web member partially disposed within the first panel and is also coupled to one web member partially disposed within the second panel.

23. A form system, comprising:

a) first and second panels, each panel having an interior surface, wherein a portion of the interior surface of the first panel is oriented toward a portion of the interior surface of the second panel and wherein the interior surfaces are spaced apart from each other;

b) a plurality of web members, each web member at least partially disposed and integrally formed within a respective one of the first and second panels so that a portion of each of the web members extends through the respective interior surfaces of the first panel and the second panel, wherein a portion of at least one of the web members extending through the interior surface defines a slot therethrough; and c) at least one flexible linking member that interconnects the first and second side panels, wherein the flexible linking member is coupled to one web member partially disposed within the first panel and also coupled to one web member partially disposed within the second panel, wherein, for at least one of the web members, the flexible linking member is coupled thereto by a portion of the flexible linking member traversing through the slot formed in that web member.

24. The form system of claim 23, wherein the interior surfaces of the first and second panels are substantially parallel to each other.

25. The form system of claim 23, further comprising contiguous concrete in contact with the interior surfaces of both the first and second panels.

26. The form system of claim 23, wherein the flexible linking member is contiguous and connects to itself to form a loop that is coupled to one web member partially disposed within the first panel and is also coupled to one member partially disposed within the second panel.

27. A form system, comprising:

a) first and second panels, each panel having an interior surface, wherein a portion of the interior surface of the first panel is oriented toward a portion of the interior surface of the second panel and wherein the interior surfaces are spaced apart from each other;

b) a plurality of web members, each web member at least partially disposed within a respective one of the first and second panels so that a portion of each of the web members extends through the respective interior surfaces of the first panel and the second panel, wherein a portion of at least one of the web members extending through the interior surface defines a slot therethrough, wherein at least one web member forms an attachment point from a portion of that web member extending from the interior surface of the respective panel in which the web member is disposed;

c) at least one flexible linking member that interconnects the first and second side panels, wherein the flexible linking member is coupled to one web member partially disposed within the first panel and also coupled to one web member partially disposed within the second panel, wherein, for at least one of the web members, the flexible linking member is coupled thereto by a portion of the flexible linking member traversing through the slot formed in that web member; and d) at least one extender, each extender having a tip end, an opposed base end, and a body extending therebetween, the base end of a size to complementarily engage one attachment point of one web member, the body defining a passage therethrough of a dimension to receive a portion of the flexible linking member therethrough, wherein a portion of the flexible linking member traverses through the slot of one web member and wherein a portion of the flexible linking member also traverses through the extender connected to the attachment point of one web member to interconnect the first and second panels.

28. The form system of claim 27, wherein the extender is constructed of high-density polypropylene or high-density polyethylene.

29. A form system, comprising:

a) first and second panels, each panel having an interior surface, wherein a portion of the interior surface of the first panel is oriented toward a portion of the interior surface of the second panel and wherein the interior surfaces are spaced apart from each other;

b) a plurality of web members, each web member at least partially disposed within a respective one of the first and second panels so that a portion of each of the web members extends through the respective interior surfaces of the first panel and the second panel, wherein a portion of at least one of the web members extending through the interior surface defines a slot therethrough; and c) at least one flexible linking member that interconnects the first and second side panels, wherein the flexible linking member is coupled to one web member partially disposed within the first panel and also coupled to one web member partially disposed within the second panel, wherein, for at least one of the web members, the flexible linking member is coupled thereto by a portion of the flexible linking member traversing through the slot formed in that web member, wherein the interior surfaces of the first and second panels are positioned at a non-parallel orientation to each other.

30. A method of constructing a concrete structure, comprising:

a) erecting first and second panels, each panel having an interior surface and a web member partially disposed therein, a portion of each of the web members extending through the respective interior surfaces of the first panel and the second panel, the panels arranged so that their interior surfaces are spaced apart and oriented toward each other;

b) attaching a base end of an extender to a portion of the web member extending through the interior surface of at least one of the first and second panels, the extender having a body defining a passage extending therethrough;

c) interconnecting the web members using a flexible linking member that traverses through the passage of the extender attached to at least one side panel; and d) pouring concrete that is to be substantially cured into a volume partially defined by the interior surfaces of the first and second panels.

31. The method of claim 30, wherein there are two extenders, a first extender attached to one web member partially disposed within the first panel and a second extender attached to one web member partially disposed within the second panel, wherein a portion of the flexible linking member traverses through the passage of the first extender and another portion of the flexible linking member traverses through the passage of the second extender to interconnect the first and second panels.

32. The method of claim 30, wherein one web member defines a slot extending therethrough, the slot located adjacent the interior surface of the panel in which the web member is disposed, the slot of a size to receive a portion of the flexible linking member therein, wherein a portion of the flexible linking member traverses through the slot of one web member and wherein another portion of the flexible linking member traverses through the passage of the extender attached to one web member to interconnect the first and second panels.

33. A form system, comprising:

a) first and second panels, each panel having an interior surface, wherein a portion of the interior surface of the first panel faces a portion of the interior surface of the second panel and wherein the interior surfaces are spaced apart from each other so that a cavity is formed therebetween;

b) a plurality of web members, each web member at least partially disposed within a respective one of the first and second panels so that a portion of each of the web members extends through the respective interior surfaces of the first panel and the second panel, wherein an attachment point is formed from a portion of each web member extending from the respective interior surfaces of the first and second panels, and wherein the attachment points are disposed within the cavity, wherein the attachment point of the web member partially disposed within the first panel are spaced apart from the attachment point of the web member partially disposed within the second panel to form at least one pair of opposed attachment points for the first and second panels;

c) at least one unitary connector, each connector having a first end and an opposed second end, wherein the first end connects to one attachment point of the pair; and d) an extender having a tip end and an opposed base end, the tip end of a size to complementarily engage one end of the connector and the base end of a size to complementarily engage one attachment point, wherein the base end of the extender connects to one attachment point of the pair and the second end of the connector connects to the tip end of the extender so as to span a desired distance between the interior surfaces of the first and second panels.

34. The form system of claim 33, wherein each of the first and second panels have at least two web members partially disposed therein and the web members are longitudinally spaced apart from each other a predetermined distance along the respective first and second panels, and wherein each of the web members partially disposed within the first panel are each aligned with one respective web members partially disposed within the second panel so that each set of opposed web members in the first and second panels form at least one pair of attachment points.

35. The form system of claim 33, wherein each web member forms a plurality of attachment points that are oriented substantially upright within the cavity, and wherein each of the attachment points of the web member partially disposed within the first panel aligns with one attachment point of the web member partially disposed within the second panel to form a plurality of pairs of opposed attachment points.

36. A form system, comprising:

a) first and second panels, each panel having an interior surface, wherein a portion of the interior surface of the first panel faces a portion of the interior surface of the second panel and wherein the interior surfaces are spaced apart from each other so that a cavity is formed therebetween;

b) a plurality of web members, each web member at least partially disposed within a respective one of the first and second panels so that a portion of each of the web members extends through the respective interior surfaces of the first panel and the second panel, wherein an attachment point is formed from the web member extending from the interior surface of the first panel and a slot is formed from a portion of the web member extending from the interior surface of the second panel;

c) at least one connector, each connector having opposed ends, each end of a size to complementarily engage one respective attachment point;

d) a flexible linking member; and e) an extender having a tip end and an opposed base end, and a body extending therebetween, the tip end of a size to complementarily engage one end of the connector and the base end of a size to complementarily engage one attachment point of one web member, the body defining a passage therethrough of a dimension to receive a portion of the flexible linking member therethrough, wherein a portion of the flexible linking member is adapted to traverse through the slot of one web member and a portion of the flexible linking member is adapted to traverse through the body of the extender.

* * * * *